US011131518B2

(12) United States Patent
Teetzel et al.

(10) Patent No.: US 11,131,518 B2
(45) Date of Patent: Sep. 28, 2021

(54) MODULAR BARREL SYSTEM AND METHOD FOR ITS MANUFACTURE

(71) Applicant: Wilcox Industries Corp., Newington, NH (US)

(72) Inventors: James W. Teetzel, Portsmouth, NH (US); Jared Majcher, Portsmouth, NH (US)

(73) Assignee: Wilcox Industries Corp., Newington, NH (US)

( * ) Notice: Subject to any disclaimer, the term of this patent is extended or adjusted under 35 U.S.C. 154(b) by 0 days.

(21) Appl. No.: 15/868,633

(22) Filed: Jan. 11, 2018

(65) Prior Publication Data

US 2018/0202736 A1 Jul. 19, 2018

Related U.S. Application Data

(60) Provisional application No. 62/446,200, filed on Jan. 13, 2017.

(51) Int. Cl.

| | |
|---|---|
| ***F41A 11/02*** | (2006.01) |
| ***F41A 21/48*** | (2006.01) |
| ***F41A 11/06*** | (2006.01) |
| *F41A 21/04* | (2006.01) |
| *F41A 21/18* | (2006.01) |

(52) U.S. Cl.

CPC ..... *F41A 11/02* (2013.01); *F41A 11/06* (2013.01); *F41A 21/482* (2013.01); *F41A 21/04* (2013.01); *F41A 21/18* (2013.01)

(58) Field of Classification Search

CPC ..... F41A 21/484; F41A 21/482; F41A 21/48; F41A 21/08; F41A 21/06; F41A 21/32; F41A 21/325; F41A 21/00; F41A 21/44; F41A 11/00; F41A 11/02

See application file for complete search history.

(56) References Cited

U.S. PATENT DOCUMENTS 37,193 A * 12/1862 Alsop ..... F41A 21/16 42/78
337,916 A * 3/1886 Ballard ..... F41A 21/16 42/76.01

(Continued)

OTHER PUBLICATIONS

Doroadmin, Armson Stealth Barrels, Sep. 27, 2010, Dorosports.wordpress.com, <https://dorosports.wordpress.com/2010/09/27/armson-stealth-barrles/> (Year: 2010).*

*Primary Examiner* — Derrick R Morgan
(74) *Attorney, Agent, or Firm* — McLane Middleton, Professional Association

(57) ABSTRACT

A modular barrel system for firearm includes a first barrel segment and a second barrel segment. Each barrel segment comprises a tubular member having an axial bore, a proximal end, and a distal end. The proximal end of the first barrel segment has a first threaded element for removably attaching the first barrel segment to a firearm. The distal end of the first barrel segment has a second threaded element and the proximal end of the second barrel segment has a third threaded element which is complementary with the second threaded element, the third threaded element for removably attaching the second barrel segment to the first barrel segment. In a further aspect, method for the manufacture of a modular barrel system are provided.

16 Claims, 21 Drawing Sheets

(56) References Cited

U.S. PATENT DOCUMENTS 487,487 A * 12/1892 Vandenbossche .... F41A 21/482 42/75.02
555,582 A * 3/1896 Perl ..... F41A 21/10 42/77
797,345 A * 8/1905 Cokeroft ..... F41A 21/40 42/79
1,013,974 A * 1/1912 Vandenbossche ..... F41A 21/40 285/82
1,266,087 A * 5/1918 Williams ..... F41A 21/40 42/79
1,605,741 A * 11/1926 Jones ..... F41A 21/00 42/79
2,014,184 A * 9/1935 Linder ..... F41A 21/481 42/75.02
2,489,568 A * 11/1949 Ferhat ..... F41A 21/40 42/79
2,981,155 A * 4/1961 Parlanti ..... F41A 21/20 89/16
3,486,411 A * 12/1969 Lichtenstern ..... F41A 21/00 89/16
3,748,957 A * 7/1973 Arnold ..... F41A 21/00 89/16
3,791,303 A * 2/1974 Sweeney ..... F42B 12/40 102/502
3,865,038 A * 2/1975 Barr ..... F42B 12/40 102/502
4,368,589 A * 1/1983 A'Costa ..... F41A 21/00 42/77
4,546,564 A * 10/1985 A'Costa ..... F41A 21/02 42/76.01
4,570,529 A * 2/1986 A'Costa ..... F41A 21/34 42/78
4,660,312 A * 4/1987 A'Costa ..... F41A 21/16 42/76.01
4,674,217 A * 6/1987 Matievich ..... F41A 21/482 42/75.02
4,676,528 A * 6/1987 Gray ..... E21B 17/0423 285/15
4,713,903 A * 12/1987 Mainland ..... F41A 21/40 42/76.02
4,770,153 A * 9/1988 Edelman ..... F41B 11/51 124/72
5,018,293 A * 5/1991 Mainland ..... F41A 15/06 42/46
5,271,312 A * 12/1993 Lishness ..... F41A 21/484 42/76.01
5,351,428 A * 10/1994 Graham ..... F41A 11/04 42/106
5,394,633 A * 3/1995 Alessandri, Jr. ..... F41G 1/02 42/135
5,544,564 A * 8/1996 Balbo ..... F41A 11/00 42/75.02
5,600,912 A * 2/1997 Smith ..... F41A 21/02 42/76.01
6,128,846 A * 10/2000 Walker ..... F41A 21/40 42/79
6,223,658 B1 * 5/2001 Rosa ..... F42B 12/40 102/501
6,266,908 B1 * 7/2001 Spencer ..... F41A 21/485 42/71.02
6,609,323 B1 * 8/2003 Donnelly ..... F41A 3/76 42/59
6,698,128 B2 * 3/2004 Kessler ..... F41A 21/00 124/83
6,807,959 B1 * 10/2004 Murdock ..... A63B 69/40 124/61
7,076,904 B1 * 7/2006 Rustick ..... F41A 21/482 42/75.01
7,353,740 B1 * 4/2008 Hoffman ..... F41A 21/26 42/107
7,866,079 B2 * 1/2011 Keeney ..... F41A 21/02 42/76.01
8,739,450 B2 * 6/2014 Piontek ..... F41A 21/10 42/77
8,991,093 B1 * 3/2015 Calvert ..... F41C 9/06 42/1.14
9,182,187 B1 * 11/2015 Griffith ..... F41A 21/32
9,222,747 B1 * 12/2015 Morrison ..... F41A 21/325
9,227,250 B2 * 1/2016 Stewart ..... B23B 35/00
9,261,318 B2 * 2/2016 Wood, Jr. ..... F41A 21/325
9,541,343 B2 * 1/2017 Dodson ..... F41A 21/12
9,964,376 B2 * 5/2018 Odle ..... F41A 21/325
2001/0034961 A1 * 11/2001 Hickerson ..... F41A 17/44 42/70.11
2003/0019352 A1 * 1/2003 Mika ..... F41A 21/36 89/14.05
2005/0066953 A1 * 3/2005 Zouboulakis ..... F41A 11/02 124/73
2005/0108916 A1 * 5/2005 Keeney ..... F41A 21/02 42/76.02
2005/0132872 A1 * 6/2005 Jensen ..... F41A 21/00 89/14.5
2005/0229464 A1 * 10/2005 Olson ..... F41B 11/00 42/76.02
2005/0262997 A1 * 12/2005 Brixius ..... F41A 13/06 89/14.1
2005/0268517 A1 * 12/2005 Withers ..... F41A 21/04 42/76.02
2007/0175078 A1 * 8/2007 Bojalad ..... F41A 21/06 42/76.1
2007/0261286 A1 * 11/2007 Briggs ..... F41A 21/02 42/76.02
2008/0022990 A1 * 1/2008 Mitchell ..... F41B 11/641 124/65
2008/0120889 A1 * 5/2008 Bose ..... F41A 21/18 42/76.02
2011/0023694 A1 * 2/2011 Haywood ..... F41A 21/482 89/9
2011/0173864 A1 * 7/2011 Christensen ..... F41A 21/02 42/78
2012/0180772 A1 * 7/2012 St. Phillips ..... F41B 11/62 124/73
2012/0311910 A1 * 12/2012 Mironichev ..... F41C 23/10 42/90
2013/0145669 A1 * 6/2013 Zonshine ..... F41A 21/10 42/75.02
2014/0115938 A1 * 5/2014 Jarboe ..... F41C 23/16 42/71.01
2015/0107143 A1 * 4/2015 Coetzee ..... F41A 19/14 42/14
2015/0135575 A1 * 5/2015 Wood, Jr. ..... F41A 21/325 42/90
2015/0267988 A1 * 9/2015 Sellars ..... F41A 21/485 42/75.02
2015/0338184 A1 * 11/2015 White ..... F41A 21/30 89/14.4
2016/0033225 A1 * 2/2016 Selvetti ..... F41A 21/482 89/14.05
2016/0061543 A1 * 3/2016 Kunau ..... F41C 3/14 42/39.5
2016/0116251 A1 * 4/2016 Mather ..... F41A 21/485 42/71.01
2017/0184367 A1 * 6/2017 Odle ..... F41A 21/325
2017/0350670 A1 * 12/2017 Grob ..... F41A 21/18
2018/0051967 A1 * 2/2018 Schwark ..... F42B 30/02
2018/0120044 A1 * 5/2018 Lagenbeck ..... F41A 21/24
2018/0128567 A1 * 5/2018 Foster ..... F41A 3/22
2018/0142980 A1 * 5/2018 Caravaggi ..... F41A 21/32
2018/0195832 A1 * 7/2018 Faxon ..... F41C 23/16
2018/0283821 A1 * 10/2018 Dodson ..... F41A 21/02
2019/0011208 A1 * 1/2019 Teetzel ..... F41A 21/02
2020/0025498 A1 * 1/2020 Wheeler ..... F41A 5/26

* cited by examiner

MODULAR BARREL SYSTEM AND METHOD FOR ITS MANUFACTURE

CROSS REFERENCE TO RELATED APPLICATION

This application claims the priority benefit of U.S. provisional application No. 62/446,200 filed Jan. 13, 2017. The aforementioned application is incorporated herein by reference in its entirety.

BACKGROUND

The present invention relates to modular barrel system for a firearm and a method for manufacturing the same.

Increasing or decreasing the length of a gun barrel provides both advantages and tradeoffs. For example, a longer barrel improves range and accuracy by increasing the exit velocity and the spin of the bullet. The longer the barrel, the greater the time interval in which the chamber pressure acts on the bullet. Also, for a given rifling twist rate (i.e., number of twists per unit of length), a longer barrel will impart more angular momentum to the bullet, thus providing increased gyroscopic stability. On the other hand, a longer barrel is less maneuverable, which may be disadvantageous in certain situations, e.g., in close quarters, dense terrain, etc. Thus, in some situations, the loss of velocity associated with a shorter barrel may be an acceptable tradeoff.

Firearm systems are known which provide barrels of different length. However, such systems are disadvantageous in that they can be difficult to carry when a soldier is forward deployed. In addition, removing a barrel from a firearm and installing another barrel can be a time consuming process and may require special tools. The present disclosure contemplates a new and improved modular barrel system and method that allow the length of the barrel of a firearm to be changed without the need to remove the barrel from the firearm.

SUMMARY

In one aspect, a modular or segmented barrel system for firearm comprises a first barrel segment and a second barrel segment. Each barrel segment comprises a tubular member having an axial bore, a proximal end, and a distal end. The proximal end of the first barrel segment has a first threaded element for removably attaching the first barrel segment to a firearm. The distal end of the first barrel segment has a second threaded element and the proximal end of the second barrel segment has a third threaded element which is complementary with the second threaded element, the third threaded element for removably attaching the second barrel segment to the first barrel segment.

In a more limited aspect, the first barrel segment is operable in a short barrel configuration when the second barrel segment is removed from the first barrel segment and the first and second barrel segments are operable in long barrel configuration when the first and second barrel segments are assembled together.

In another more limited aspect, the first and third threaded elements are male threaded elements having an external helical thread and the second threaded element is a female threaded element having an internal helical thread.

In yet another more limited aspect, the distal end of the second barrel segment has a fourth threaded element. In a further limited aspect, the fourth threaded element is a male threaded element configured to attach one or both of a firearm accessory device and a third barrel segment to the second barrel segment.

In another more limited aspect, the modular barrel system comprises a third barrel segment comprising a tubular member having an axial bore, a proximal end, and a distal end, wherein the proximal end of the third barrel segment has a fifth threaded element which is complementary with the fourth threaded element, the fifth threaded element for removably attaching the third barrel segment to the second barrel segment.

In another more limited aspect, the first barrel segment has a first externally upset portion adjacent the second threaded element and the second barrel segment has a second externally upset portion adjacent the third threaded element. The first externally upset portion and the second externally upset portion abut each other when the first barrel segment is assembled to the second barrel segment.

In another more limited aspect, the modular barrel system includes a locking mechanism comprising a first axially-extending groove formed in the first externally upset portion and a second axially-extending groove formed in the second externally upset portion, the first and second axially-extending grooves being circumferentially aligned when the first and second barrel segments are assembled together. A locking bar is slidably received within the second axially-extending groove and a spring member has a first end fixed within the second axially-extending groove and a second end attached to the locking bar. The spring member is configured to urge a portion of the locking bar into the first axially-extending groove when the first and second barrel segments are assembled together, the locking bar fitting together with the first and second axially-extending grooves so that the assembled first and second barrel segments cannot substantially rotate with respect to each other.

In another more limited aspect, the locking mechanism includes a key member having a shaft portion slidably received in the first axially-extending groove for manually urging the locking bar out of the first axially-extending groove against the urging of the spring member to permit the first and second barrel segments to rotate with respect to each other.

In another more limited aspect, the first and second barrel segments are formed from a single, monolithic piece of barrel stock material.

In another more limited aspect, at least a portion of the first barrel segment, second barrel segment, or both, is wrapped with a fiber reinforced composite material. In further limited aspect, the fiber reinforced composite material comprises carbon fibers in a polymer matrix.

In another more limited aspect, the axial bore of each of the first barrel segment and the second barrel segment is rifled.

In another aspect, a method of manufacturing a modular barrel system includes the steps of forming a first solid barrel segment and a second sold barrel segment, each of the first and second solid barrel segments having a proximal end and a distal end. A first threaded element is formed on the proximal end of the first solid barrel segment for removably attaching the first solid barrel segment to a firearm. A second threaded element is formed on the distal end of the first solid barrel segment and a third threaded element is formed on the proximal end of the second solid barrel segment. The third threaded element is complementary with the second threaded element and the third threaded element is for removably attaching the second solid barrel segment to the first solid barrel segment. The first and second solid barrel segments are assembled together and an axial bore is formed in the first and second solid barrel segments to form first and second tubular barrel segments.

In more limited aspect, rifling is formed on an inner surface of the axial bore of the first and second tubular barrel segments.

In another more limited aspect, the first and third threaded elements are male threaded elements having an external helical thread and the second threaded element is a female threaded element having an internal helical thread.

In another more limited aspect, the first solid barrel segment has a first externally upset portion at the distal end thereof and the second solid barrel segment has a second externally upset portion at the proximal end thereof.

In still another more limited aspect, a first axially-extending groove is formed in the first externally upset portion and a second axially-extending groove is formed in the second externally upset portion, the first and second axially-extending grooves being circumferentially aligned. A locking mechanism in the second axially extending groove includes a locking bar slidably received within the second axially-extending groove and a spring member having a first end fixed within the second axially-extending groove and a second end attached to the locking bar. The spring member is configured to urge a portion of the locking bar into the first axially-extending groove when the first and second tubular barrel segments are assembled together.

In another more limited aspect, a solid piece of stock material is machined to form a monolithic outline of the modular barrel system prior to forming the first and second solid barrel segments, machining and the monolithic outline is then cut into the first and second solid barrel segments. In further limited aspect, the monolithic outline has an enlarged diameter portion and the monolithic outline is cut into the first and second solid barrel segments at the enlarged diameter portion to provide the first solid barrel segment having a first externally upset portion at the distal end of the first solid barrel segment and the second solid barrel segment having a second externally upset portion at the proximal end of the second solid barrel segment.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
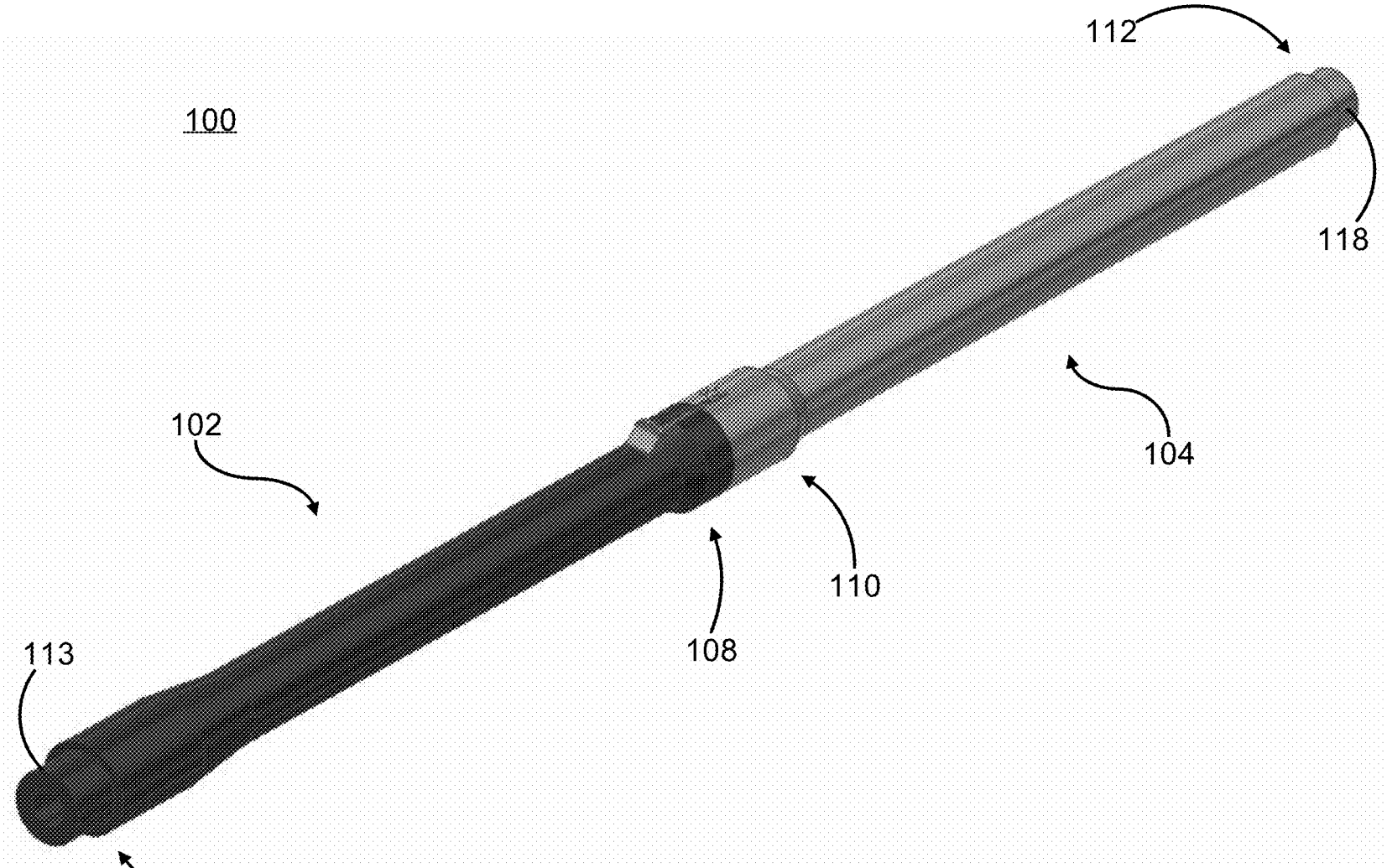
FIG. 1 is an isometric view of a modular barrel system in accordance with an exemplary embodiment.
Figure 2:
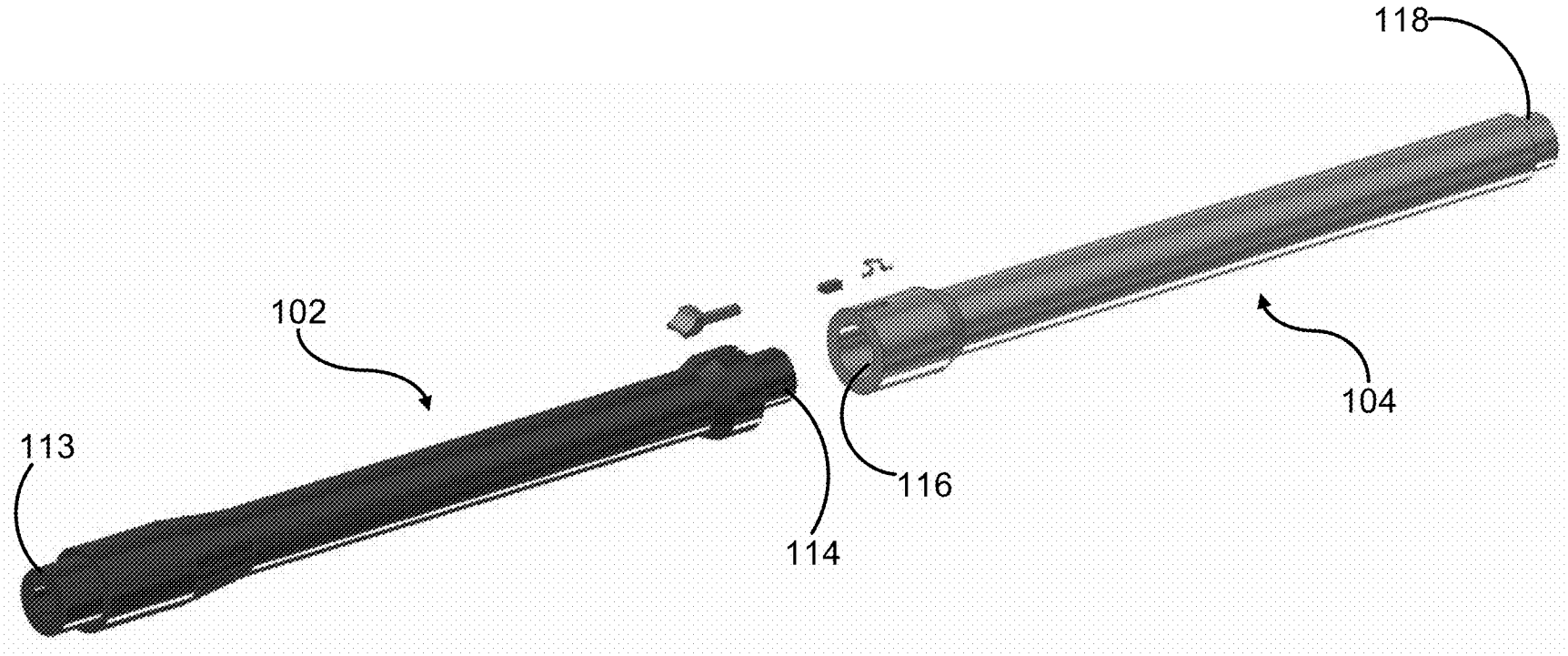
FIG. 2 is an exploded view of the modular barrel system appearing in FIG. 1.
Figure 3:
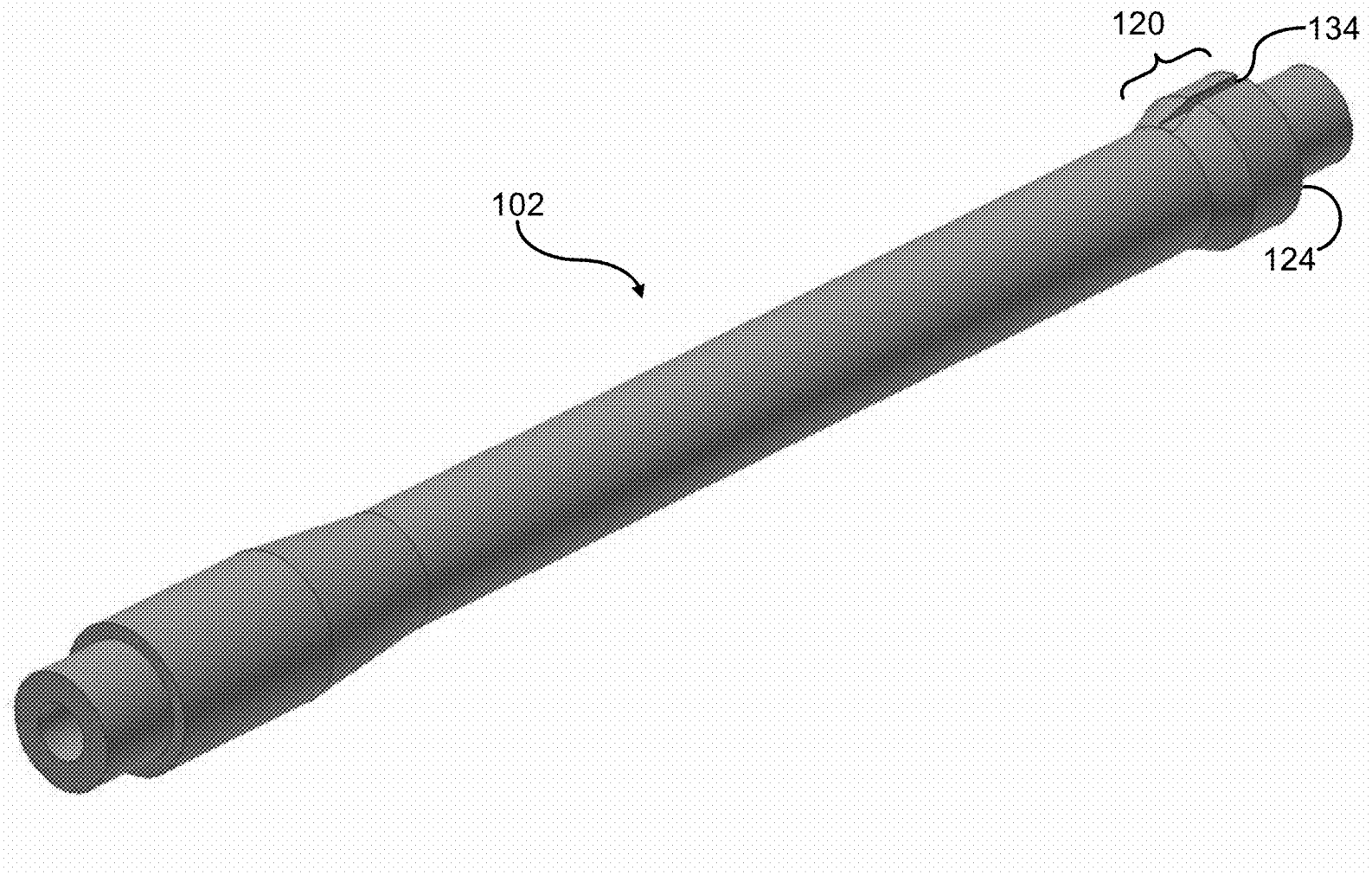
FIG. 3 is an enlarged isometric view of the primary barrel segment.
Figure 4:
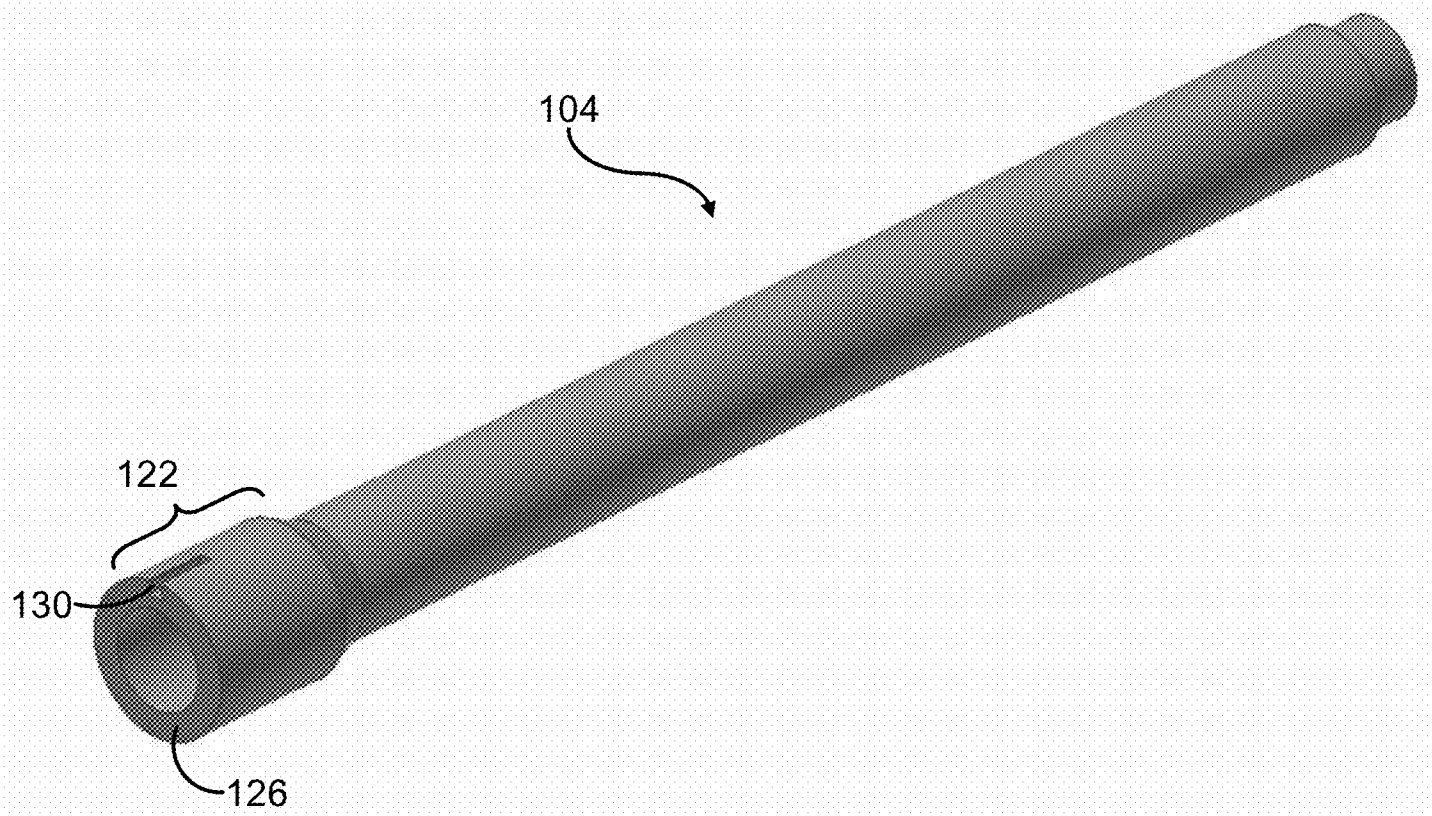
FIG. 4 is an enlarged isometric view of the secondary barrel segment.
Figure 5:
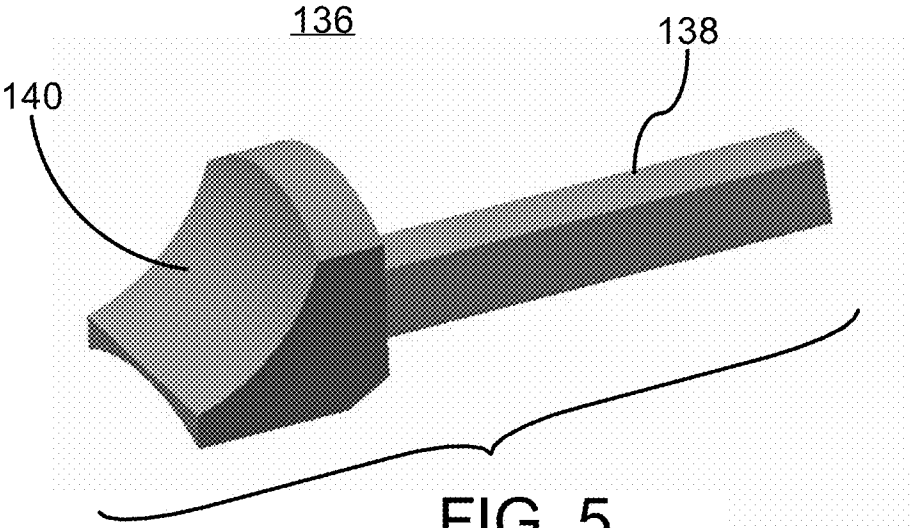
FIG. 5 is an enlarged isometric view of a key for an exemplary release mechanism.
Figure 6:
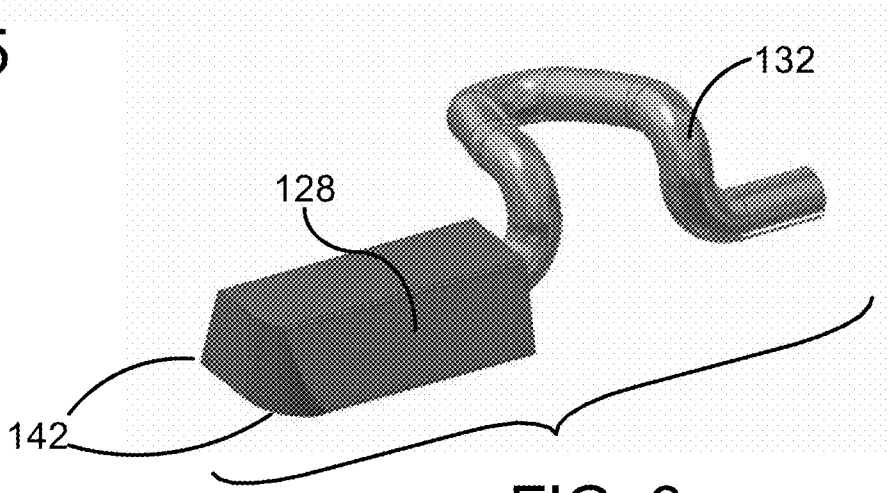
FIG. 6 is an enlarged isometric view of a locking bar and spring for an exemplary locking mechanism.
Figure 7:
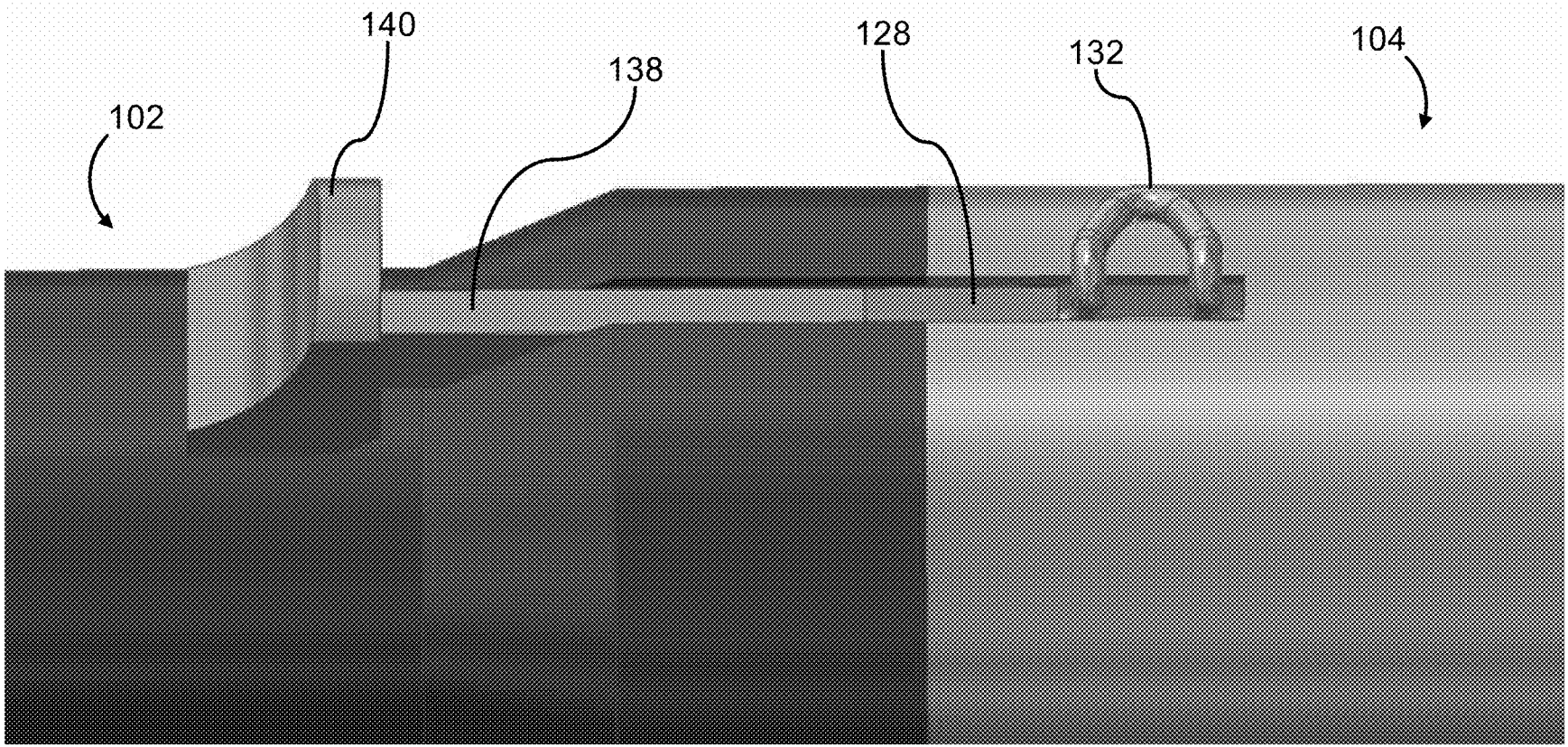
FIGS. 7 and 8 are enlarged fragmentary views showing the barrel joint with the segments attached in operable position and the locking mechanism engaged.
Figure 8:
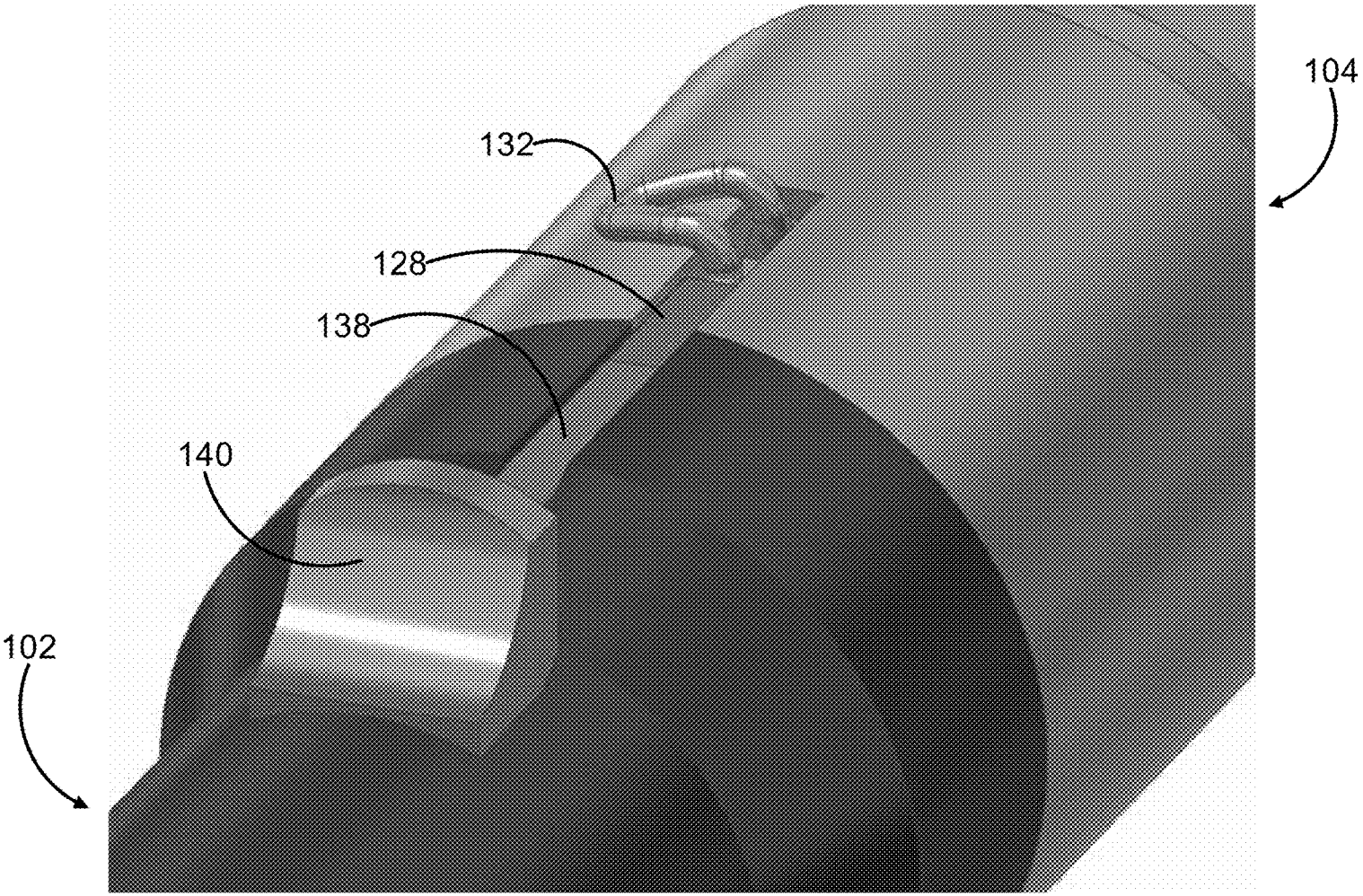
Figure 9:
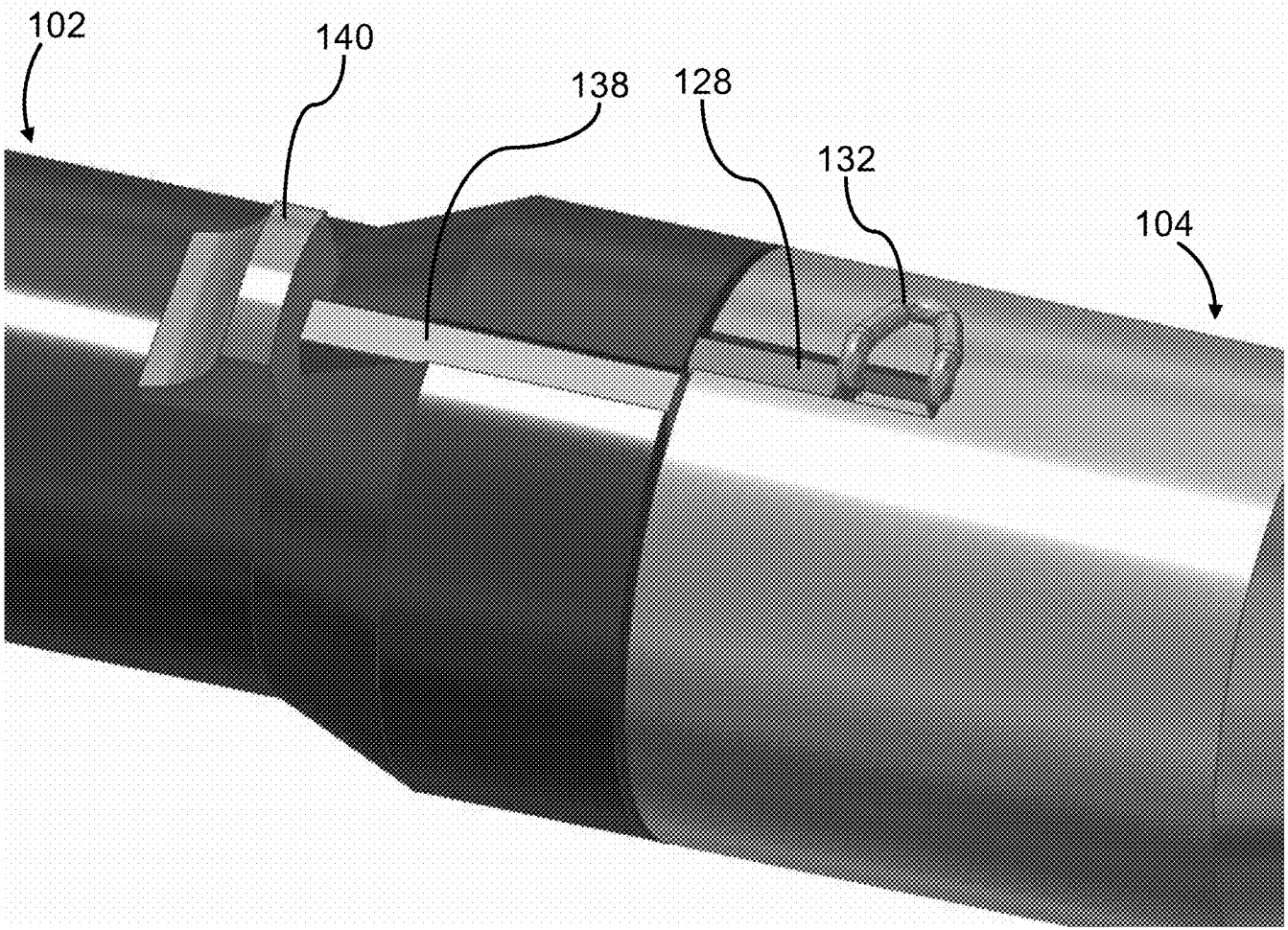
FIG. 9 is an enlarged fragmentary view showing the barrel joint with the segments partially attached in non-operable position and the locking mechanism disengaged.
Figure 10:
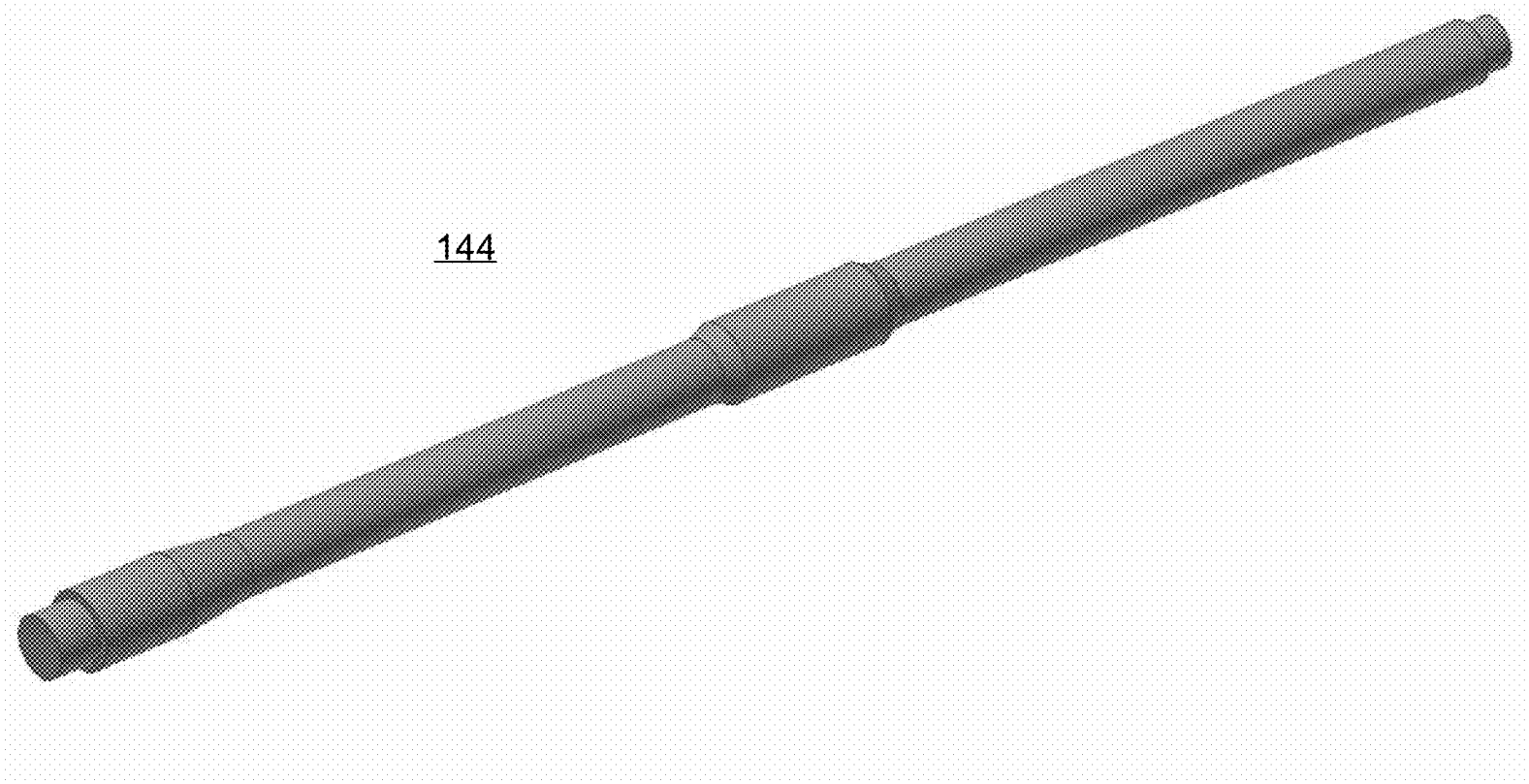
FIG. 10 is an isometric view of a solid outline or blank for producing the modular barrel system.
Figure 11:
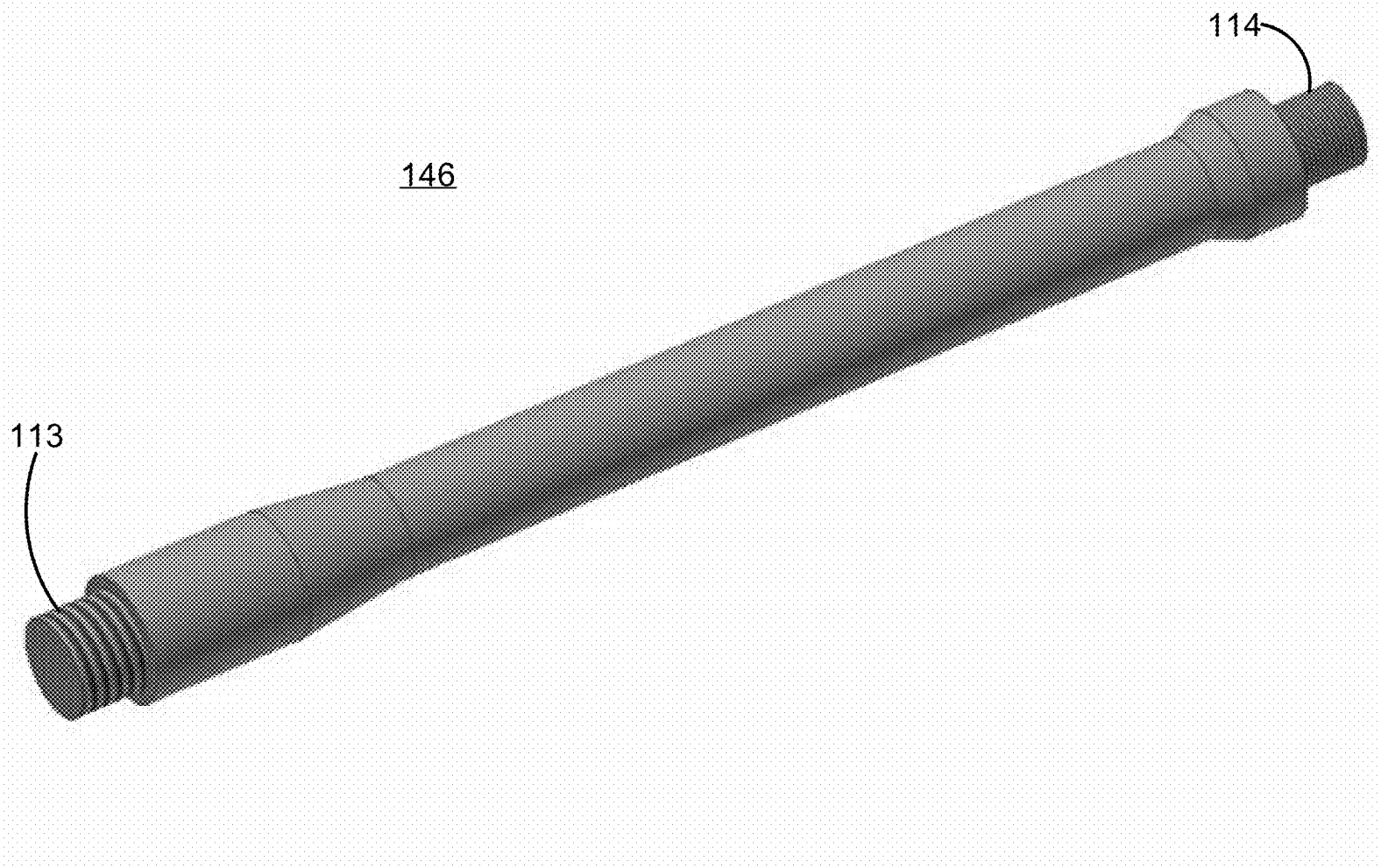
FIG. 11 is an enlarged isometric view of the solid primary section, prior to drilling the bore.
Figure 12:
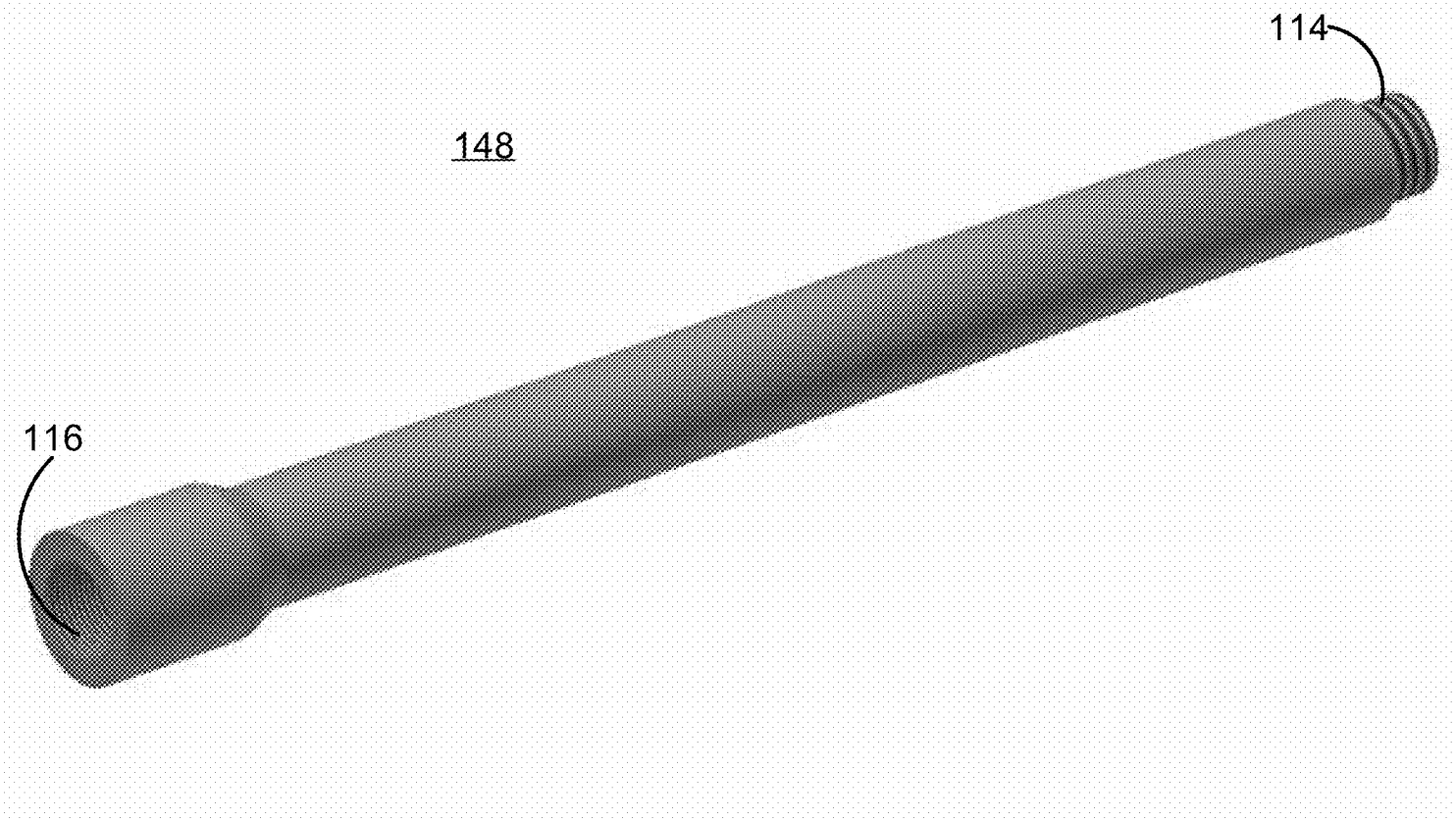
FIG. 12 is an enlarged isometric view of the solid secondary section, prior to drilling the bore.
Figure 13:
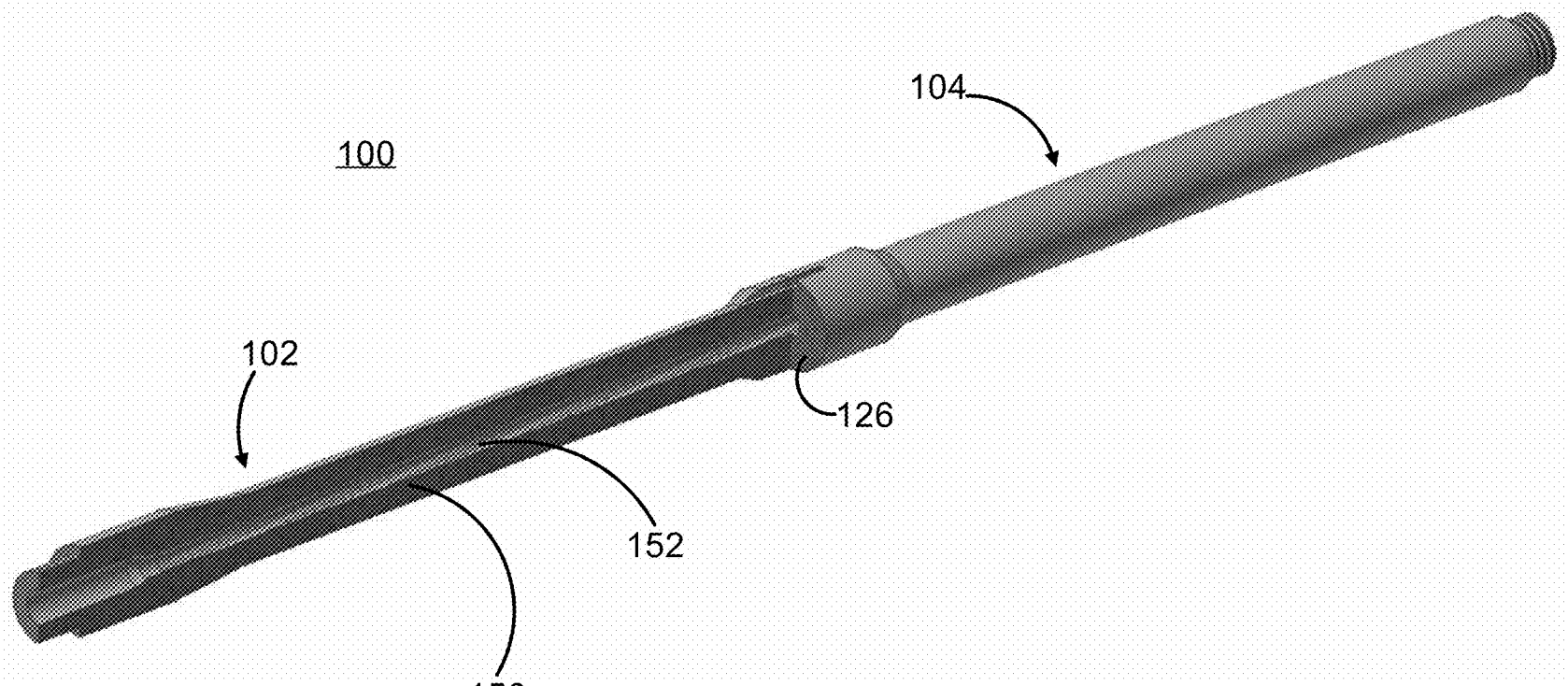
FIG. 13 is an isometric, partially cross-sectional view of the modular barrel system appearing in FIG. 1.
Figure 14:
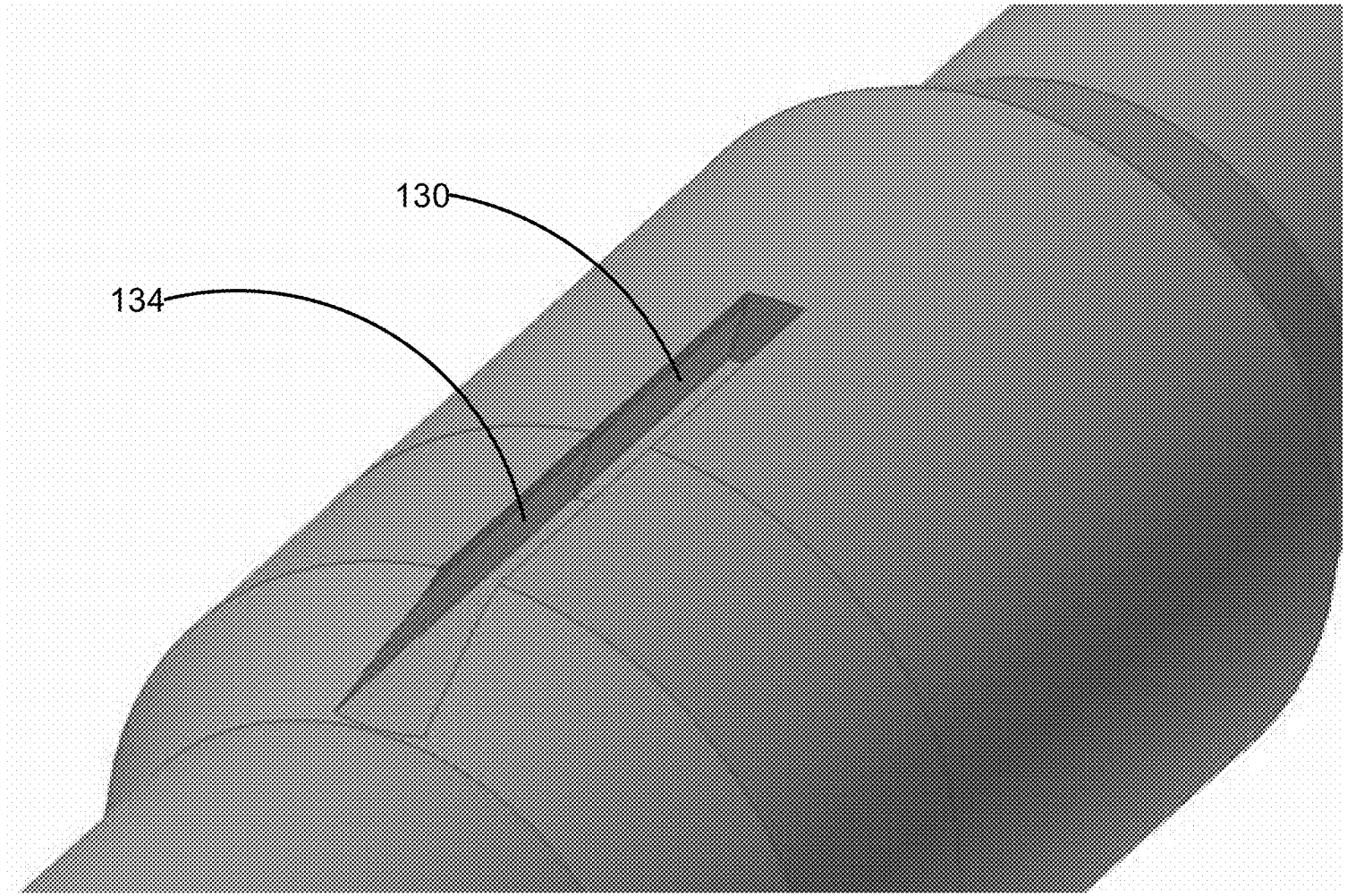
FIG. 14 is an enlarged, fragmentary isometric view of barrel joint with aligned indexing grooves.

Referring now to the drawings, where like reference numerals refer to like or analogous components throughout the several views, FIGS. 1-14 illustrate a modular barrel system 100 comprising a primary segment 102 and a secondary segment 104 is illustrated. Although the present invention is shown and described by way of reference to a two-segment system as illustrated, it will be recognized that the modular barrel system herein may have any other number of segments, e.g., 2, 3, 4, 5, or more. Such one or more additional segments may be intermediate segments disposed between the primary segment and the secondary segment.

The barrel segments 102, 104 can be produced from any type of material used for firearm barrels, including steel alloys (e.g., chrome molly steel, stainless steel) and others.

The primary segment 102 has a proximal or breech end 106 which is adapted, e.g., via a threaded element 113, for attachment to a firearm, e.g., for attachment to an upper receiver of a firearm via a barrel nut assembly. The primary segment also has a distal end 108 which is configured for attachment to a proximal end 110 of the secondary segment 104. The secondary segment also has a distal end, i.e., muzzle or exit end, 112.

The distal end 106 of the primary segment 102 is provided with a male threaded element 114 and the proximal end of the secondary segment 104 of the primary segment 102 is provided with a female threaded element 116 for coupling the primary segment 102 to the secondary segment 104. The female threaded element 116 mates with the male element 114, e.g., they are complementary in terms of their shape, arrangement, pitch and so forth.

It will be recognized that other configurations other than those appearing in the illustrated embodiment are contemplated. For example, in alternative embodiments, the distal end of the primary segment 102 is provided with a female threaded element and the proximal end of the secondary segment 104 is provided with a male threaded element. In other alternative embodiments, both the distal end of the primary segment 102 and the proximal end of the secondary segment 104 are provided with a male threaded elements and coupled with a coupling section (e.g., a short coupling section) having female threaded elements on each end. In yet other alternative embodiments, both the distal end of the primary segment 102 and the proximal end of the secondary segment 104 are provided with a female threaded elements and coupled with a coupling section (e.g., a short coupling section) having male threaded elements on each ends.

The internal diameter of the primary segment and secondary segment (any optional, additional segments) are virtually identical. In certain embodiments, rifling (i.e., helical grooves) is provided on the surface of the bore defined by the system 100 and preferably the primary and secondary segments are indexed so that the rifling is seamless at the joints between the segments as will be described in greater detail below.

In certain embodiments, the distal end 112 of the secondary segment 104 includes a threaded end 118, e.g., a male threaded end, for attachment of an accessory device (not shown) such as a flash suppressor at the barrel exit.

In certain embodiments, the distal end 108 of the primary segment 102 has an externally upset (thickened) portion 120. The proximal end of the secondary segment 104 has an externally upset (thickened) portion 122. The upsetting 120, 122 adds strength to the joint by providing additional material where the threads are cut. The distal end of the primary segment 102 has an abutting surface 124 which faces and abuts an aligned abutting surface 126 on the proximal end of the secondary segment 104. The abutting surfaces 124, 126 and/or the threaded elements 114, 116 are configured to provide a sealing interference with respect to high internal gaseous fluid pressures.

In certain embodiments, a locking mechanism is provided to provide a precise angular orientation of the primary segments 102 in relation to the secondary segment 104. In the illustrated embodiment, the locking mechanism includes a locking bar 128 which is slidably received within a complementary, axially extending groove 130 formed in the portion 122. A spring, e.g., which may be formed of spring metal, or other resilient member 132 has one fixed end within the groove 130 and another end attached to the locking bar 128. When the primary and secondary segments 102, 104 are joined and in the operational position, the surfaces 124 and 126 are abutting each other and the spring 132 urges the locking bar 128 into an aligned axial groove 134 formed in the portion 120 on the distal end of the primary segment 102.

The locking mechanism also includes a key 136 having a shaft portion 138 slidably received in the groove 134 and a button portion 140 configured for manually sliding the key within the groove 134. The cross-sectional shape of the grooves 130, 134 are the same and are complementary with the cross-sectional shape of the locking bar 128, and the key shaft 138. In the illustrated embodiment, the cross-sectional shape of the grooves 130, 134 locking bar 128, and the key shaft 138, is trapezoidal (dovetail) to limit movement to the axial direction, although it will be recognized that other geometrical configurations can also be used.

In operation, when is desired to lengthen the barrel by attaching the secondary segment 104 to the primary segment 102. The male element 114 is then threaded into the female element 116. Rotation of the secondary segment 104 in one direction axially advances the surface 126 toward the surface 124 and rotation of the secondary segment 104 in the opposite direction axially retracts the surface 126 away from the surface 124. The surface 124 also bears against the protruding end of the locking bar 128, and compresses the spring 132 as the secondary segment 104 is threaded onto the primary segment 102. Once the surface 124 abuts the surface 126 and the groove 134 is in alignment with the locking bar 128, the locking bar 128 is urged by the spring into the groove 134, thereby preventing any further relative rotation between the primary segment 102 and the secondary segment 104.

When it is desired to shorten the barrel by removing the secondary segment 104 from the primary segment 102, the release button 136 is pressed into the groove 134 and manually pressed against the locking bar 128 against the urging of the spring 132 to move the locking bar 128 out of engagement with the groove 134. The secondary segment 104 can then be rotated to remove the secondary segment 104 from the primary segment 102. The locking bar 128 may have at least one rounded, angled, or tapered end or corners 142 to facilitate movement past the shaft portion of the key 136 and/or edges of the groove 134 when the secondary segment 104 is being threaded onto and/or unthreaded from the primary segment 102.

Manufacturing Method 1

In a first method of manufacturing the modular barrel system herein, in step 1, a solid piece of stock material is machined to form a monolithic outline 144 of the barrel system, exclusive of the grooves 130, 134, threaded elements, etc. In step 2, the monolithic outline 144 is then cut into solid segments 146 and 148 of appropriate length and the threaded elements 113, 114, 116, 118 are added. It will be recognized that once the male and female threaded elements for adjoining the modular sections 102, 104 (e.g., threaded elements 114, 116) are cut, the assembled barrel system 100 will be shortened by the degree of overlap between the male and female threaded elements. Thus, in certain embodiments, the monolithic outline 144 formed in step 1 can be made longer than the desired final overall segmented barrel assembled length by the amount of such overlap. In certain embodiments, the additional length of the monolithic outline 144 is added at the upset region(s) (120, 122) at the position(s) of the joints between segments 102, 104. It will be recognized that the threaded elements 113, 118 may be cut before the outline 144 is cut into the segments 146, 148.

In step 3, the threaded segments 146, 148 formed in step 2 are assembled and locked and the bore 150 is drilled and reamed. After drilling and reaming, the rifling 152 is added, e.g., via cut rifling, button rifling (broaching), and the like. In step 4, the grooves 130, 134 are cut and the spring 132 and the locking bar 128 are added. In certain embodiments, step 4 is performed before step 3. A threaded element for attaching the primary segment to a firearm receiver or a threaded element at the exit end of the secondary segment for attaching a firearm accessory device such as a flash suppressor may be added at any time after step 1. Because manufacturing method 1 forms the barrel segments from a single piece of barrel stock, the segments have uniform metallurgy. Thus, deformities that could affect accuracy as a result of different rates of thermal expansion between the segments are minimized. Thus, manufacturing method 1 is particularly advantageous for barrels that will be subject to high degrees of heat strain, e.g., from high rates of fire and/or high energy rounds.

Manufacturing Method 2

A second method of manufacturing the modular barrel system herein is similar to method 1, except that in step 1, a separate, solid outline of each barrel segment (not shown) is separately formed (machined), excluding the threaded elements 114, 116 and grooves 130 and 134. In step 2, the threaded elements are added. In step 3, the threaded segments formed in step 2 are assembled and the bore is drilled and reamed. After drilling and reaming, the rifling is added, e.g., via cut rifling, button rifling, and the like. In step 4, the grooves 130, 134 are cut and the spring 132 and the locking bar 128 are added. In certain embodiments, step 3 is performed before step 4. Alternatively, in certain embodiments, step 4 is performed before step 3. The threaded element 113 at the breech end for attaching the primary segment 102 to a firearm receiver or the threaded element 118 at the exit end of the secondary segment 104 for attaching a firearm accessory device such as a flash suppressor may be added at any time after step 1.

In this manner, for both manufacturing methods 1 and 2, the bore of each segment is virtually identical in diameter and alignment and the lands and grooves of the rifling are continuous and uninterrupted at the joint between the barrel segments when the segments are attached and the keying mechanism engaged. The manufacturing methods 1 and 2 can readily be adapted to produce all manner of other barrel configurations, including barrel systems having more than two segments and fiber (e.g., carbon fiber) reinforced composite wrapped barrel systems, exemplary embodiments of which are discussed below.

Figure 15:
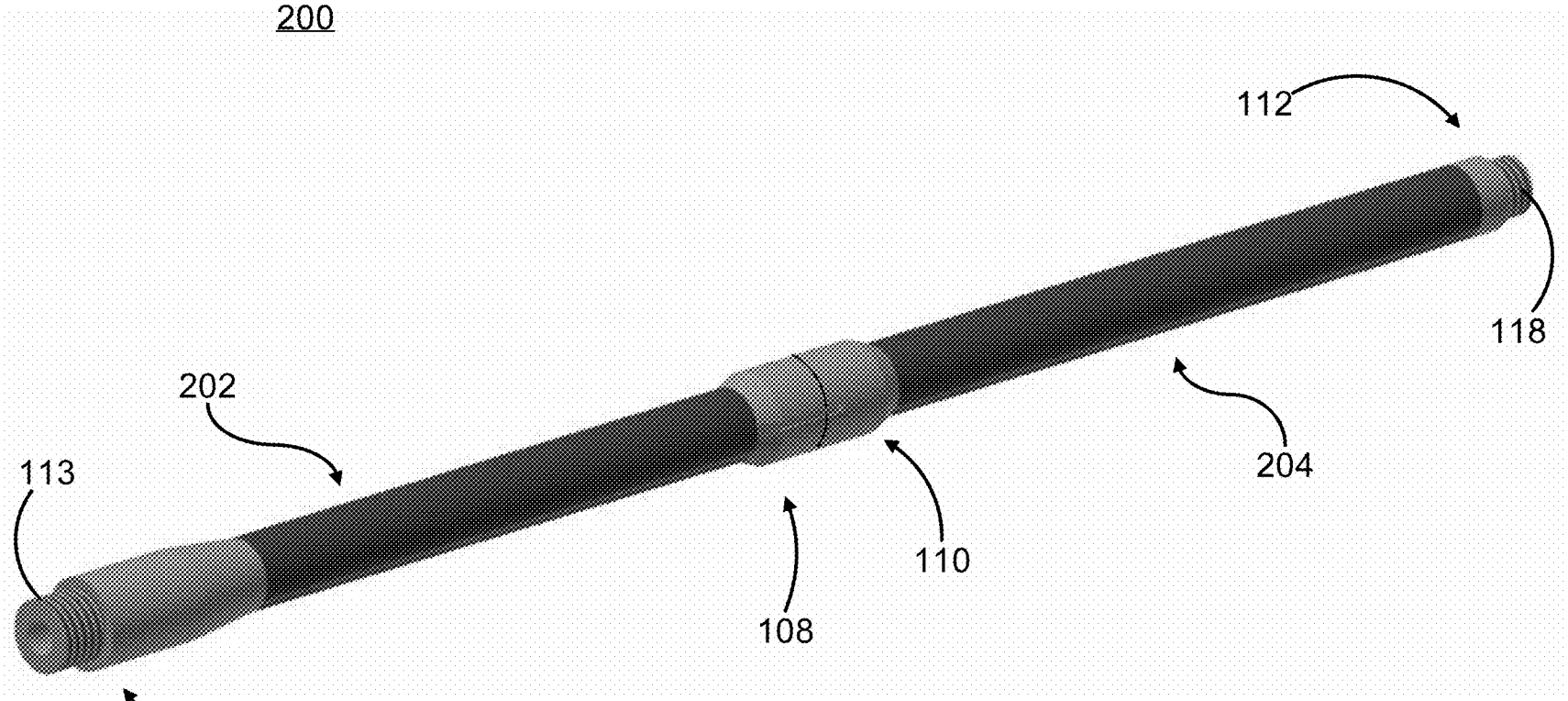
FIG. 15 is an isometric view of a modular barrel system in accordance with a second exemplary embodiment.
Figure 16:
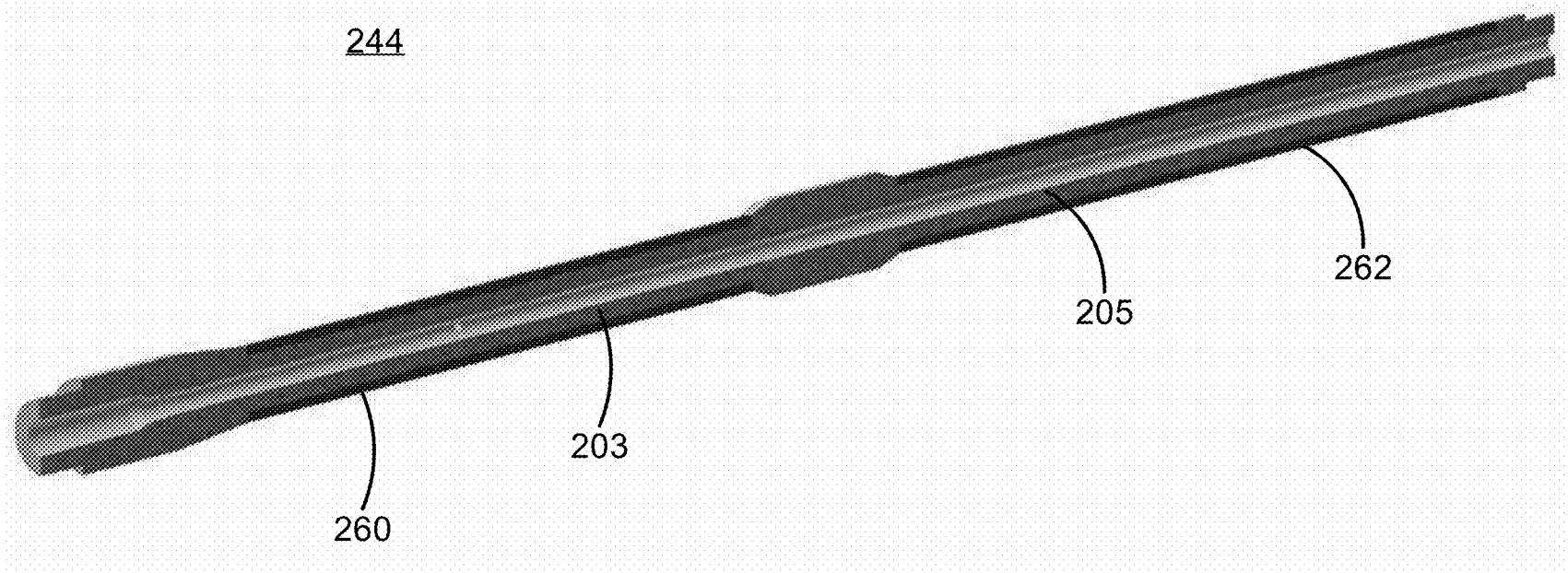
FIG. 16 is a cross-sectional view of a unitary blank for the manufacture of the modular barrel system appearing in FIG. 15.

Referring now to FIG. 15 shows a fiber composite wrapped modular barrel system 200 comprises a primary segment 202 and a secondary segment 204. In certain embodiments, the composite is a carbon fiber reinforced polymer composite material. A blank 244 for preparing the system 200 appears in FIG. 16. The carbon fiber wrapped barrel system herein may offer certain advantages such as reduced weight, increased heat dissipation, and/or increased stiffness over comparable barrel non-wrapped barrels. Although the depicted system 200 is shown and described by way of reference to a two-segment system as illustrated, it will be recognized that the modular barrel system 200 herein may have any other number of segments, e.g., 2, 3, 4, 5, or more, e.g., with the additional segments being intermediate segments disposed between the primary segment and the secondary segment.

The barrel segments 202, 204 include metal liner portions 203, 205, respectively, which can be formed of any type of material used for firearm barrels, including steel alloys (e.g., chrome molly steel, stainless steel) and others. The metal liner portions 203, 205 may have a thinner wall thickness than a standard barrel and include an outer layer 260, 262, respectively, of a fiber reinforced composite material. In certain embodiments, the fiber reinforced composite material comprises carbon fibers in an epoxy resin matrix.

The primary segment 202 has a proximal or breech end 206 which is adapted, e.g., via a threaded element 213, for attachment to a firearm, e.g., for attachment to an upper receiver of a firearm via a barrel nut assembly. The primary segment 202 also has a distal end 208 which is configured for attachment to a proximal end 210 of the secondary segment 204. The secondary segment 204 also has a distal end, i.e., muzzle or exit end, 212.

The distal end 206 of the primary segment 202 is provided with a male threaded element 214 and the proximal end of segment 204 of the primary segment 202 is provided with a female threaded element 216 for coupling the primary segment 202 to the secondary segment 204. The female threaded element 216 mates with the male element 214, e.g., they are complementary in terms of their shape, arrangement, pitch and so forth.

It will be recognized that other configurations other than those appearing in the illustrated embodiment are contemplated. For example, in alternative embodiments, the distal end of segment 202 is provided with a female threaded element and the proximal end of segment 204 is provided with a male threaded element. In other alternative embodiments, both the distal end of segment 202 and the proximal end of segment 204 are provided with a male threaded elements and coupled with a coupling section (e.g., a short coupling section) having female threaded elements on each end. In yet other alternative embodiments, both the distal end of segment 202 and the proximal end of segment 204 are provided with a female threaded elements and coupled with a coupling section (e.g., a short coupling section) having male threaded elements on each ends.

The internal diameter of the primary segment 202 and secondary segment 204 (any optional, additional segments) are virtually identical. In certain embodiments, rifling (i.e., helical grooves) is provided on the surface of the bore defined by the system 200 and preferably the primary and secondary segments are indexed so that the rifling is seamless at the joints between the segments as described above.

In certain embodiments, the distal end 212 of the secondary segment 204 includes a threaded end 218, e.g., a male threaded end, for attachment of an accessory device (not shown) such as a flash suppressor 154 (see, e.g., FIGS. 19 and 20) at the barrel exit.

The distal end 208 of the primary segment 202 has an externally upset portion 220. The proximal end of the secondary segment 204 has an externally upset (thickened) portion 222. An upset portion 221 also appears at the breech end of the primary segment 202. The upsetting 220, 222 adds strength to the joint by providing additional material where the threads are cut. The primary segment 202 and secondary segment 204 have abutting surfaces and the joint may be otherwise as described above by way of reference to the system 100. The system 200 also includes a locking mechanism and key cooperating with aligned grooves, which may be as described above with respect to the locking bar 128, grooves 130 and 134, spring 132, and key 136.

The system 200 may be produced by either manufacturing method 1 of 2 as described above, with the additional step of providing the fiber reinforced composite wrap 260, 262 by wrapping a carbon fiber mat impregnated with a resin matrix material, e.g., epoxy resin, about each of the metal liner portions 203, 205 under high pressure and curing the resin matrix material. In certain embodiments, the wrap portions 260, 262 are applied to the liner portions prior to drilling and rifling the bore.

Figure 17:
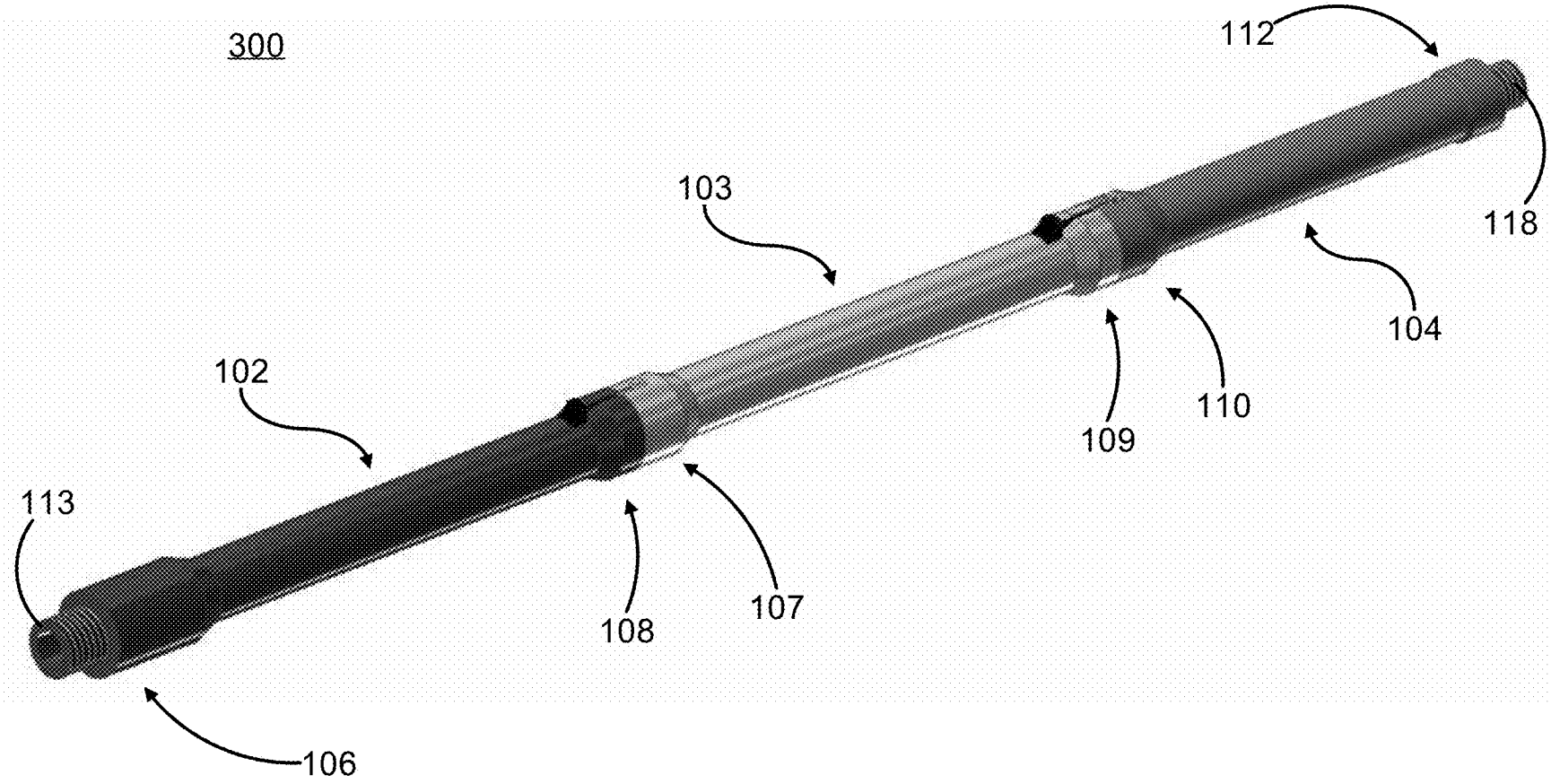
FIG. 17 is an isometric view of a modular barrel system in accordance with a third exemplary embodiment.
Figure 18:
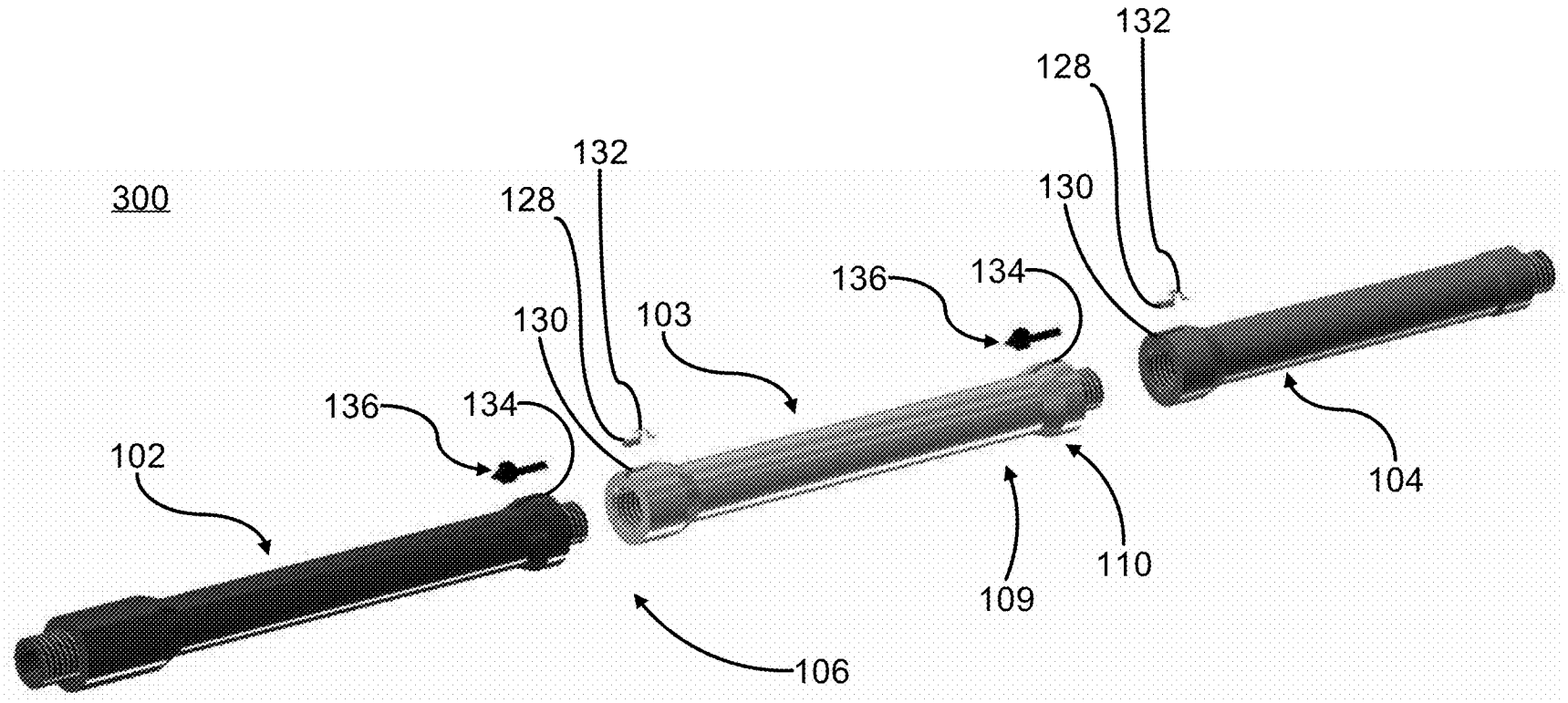
FIG. 18 is an isometric view of the modular barrel system appearing in FIG. 17.

Referring now to FIGS. 17-18, there appears an exemplary modular barrel system 300 having three segments. The system 300 includes an intermediate segment 103 disposed between a primary (breech) segment 102 and a secondary (muzzle) segment 104. The primary segment 102 and the secondary segment 104 are as otherwise described above by way of reference to the embodiment appearing in FIGS. 1-14, except that the distal end 107 is removably attached to a proximal end 107 of the intermediate segment 103 and the proximal end 110 of the secondary segment 104 is removably attached to a distal end 109 of the intermediate segment 103. A locking mechanism includes aligned grooves 130, 134 on adjacent segments and a locking bar 128 biased with a spring member 132 is includes at each joint between the segments 102, 103, and 104 and a release key 136 is provided for unlocking the segments, the locking mechanism and key being as described above.

In embodiments having more than two segments, it is preferred that the barrel segments be configured to be attached in the same configuration as when the rifling was cut. For example, in a three-segment configuration having a breech section, a center section, and a muzzle section, three configurations are contemplated. Configuration 1 is the breech section used alone for a short barrel configuration. Configuration 2 is the breech section used with the center section attached for a medium barrel configuration. Configuration 3 is the breech section used with the center section attached to the breech section and the muzzle section attached to the center section for a long barrel configuration. Keying geometries and/or differences in the size or pitch of the threaded elements/counter bores may be provided to ensure that connection of the segments in a combination other than the aforementioned configurations 1-3 (e.g., in the three-segment embodiment described, reversing the order of attachment of the center and muzzle sections or attaching the muzzle section directly to the breech section) is prevented.

Although the keying/indexing system has been illustrated and described herein by way of a presently preferred embodiment comprising a locking bar on the secondary segment engaging an indexed groove on the primary segment, it will be recognized that other keying mechanisms can also be used, including retention pins, cam locks, axially slidable locking collars, and the like.

Figure 19:
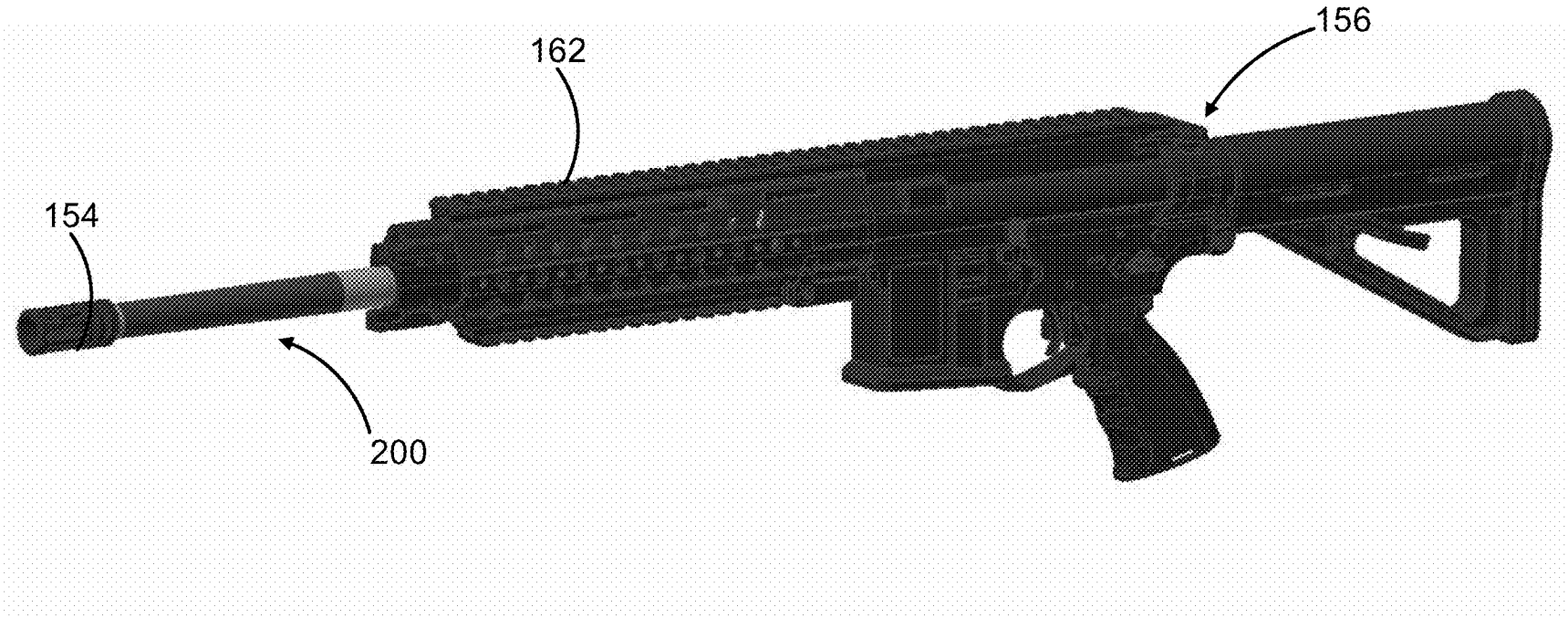
FIG. 19 illustrates an exemplary modular barrel assembly attached to a firearm in a long barrel configuration.
Figure 20:
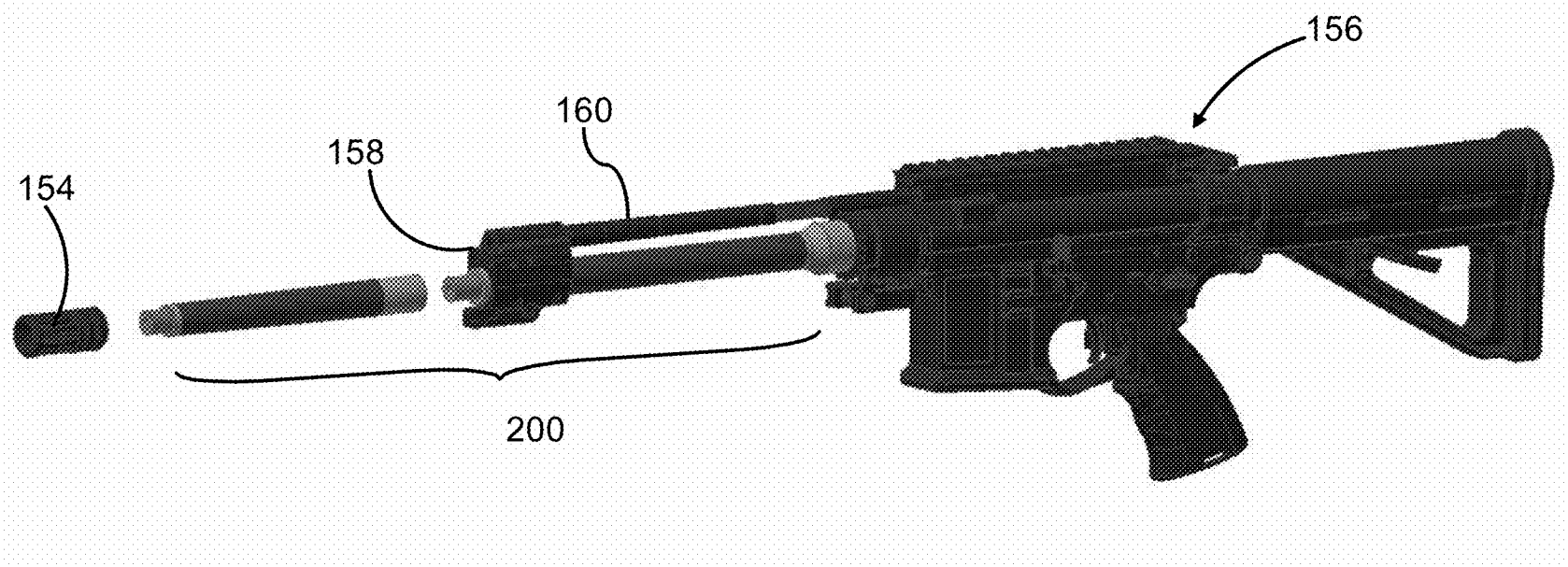
FIG. 20 is an exploded view of the modular barrel assembly configuration appearing in FIG. 19, with the handguard removed for ease of exposition.
Figure 21:
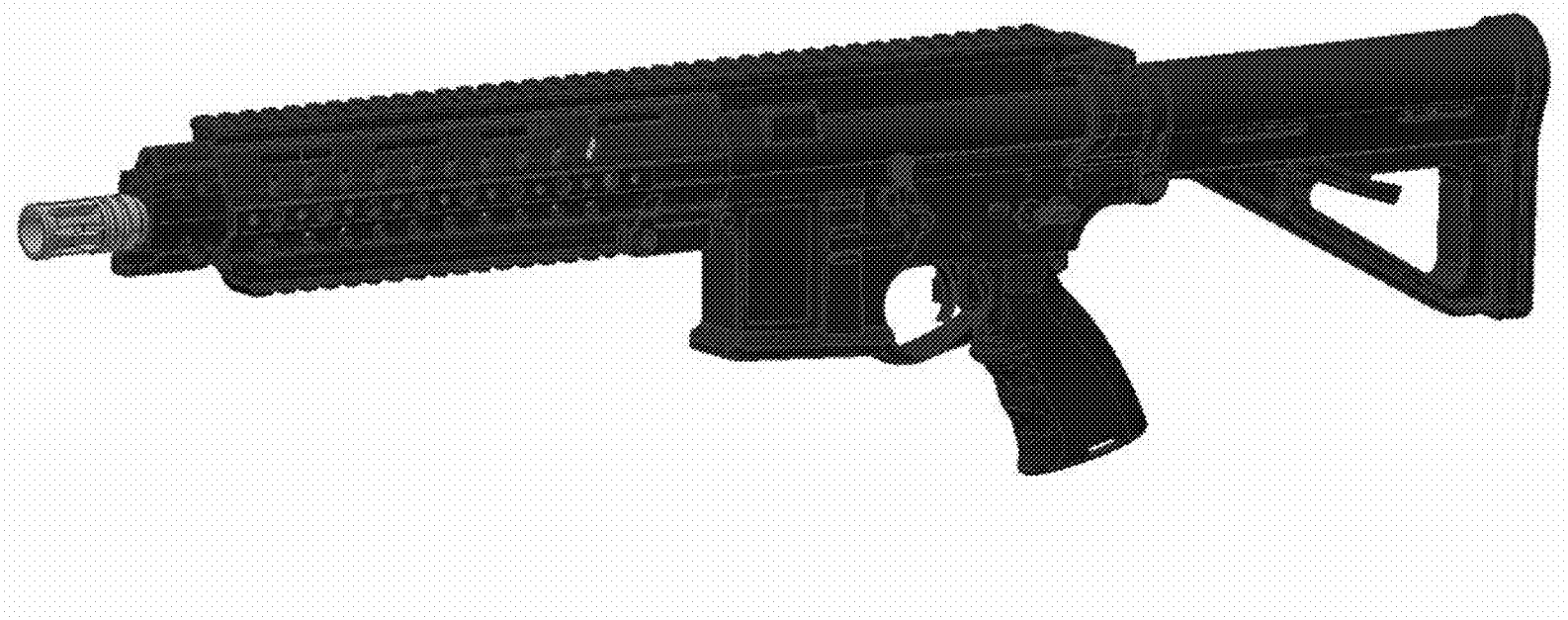
FIG. 21 illustrates the modular barrel system of FIG. 19 attached to a firearm in a short barrel configuration.
Figure 22:
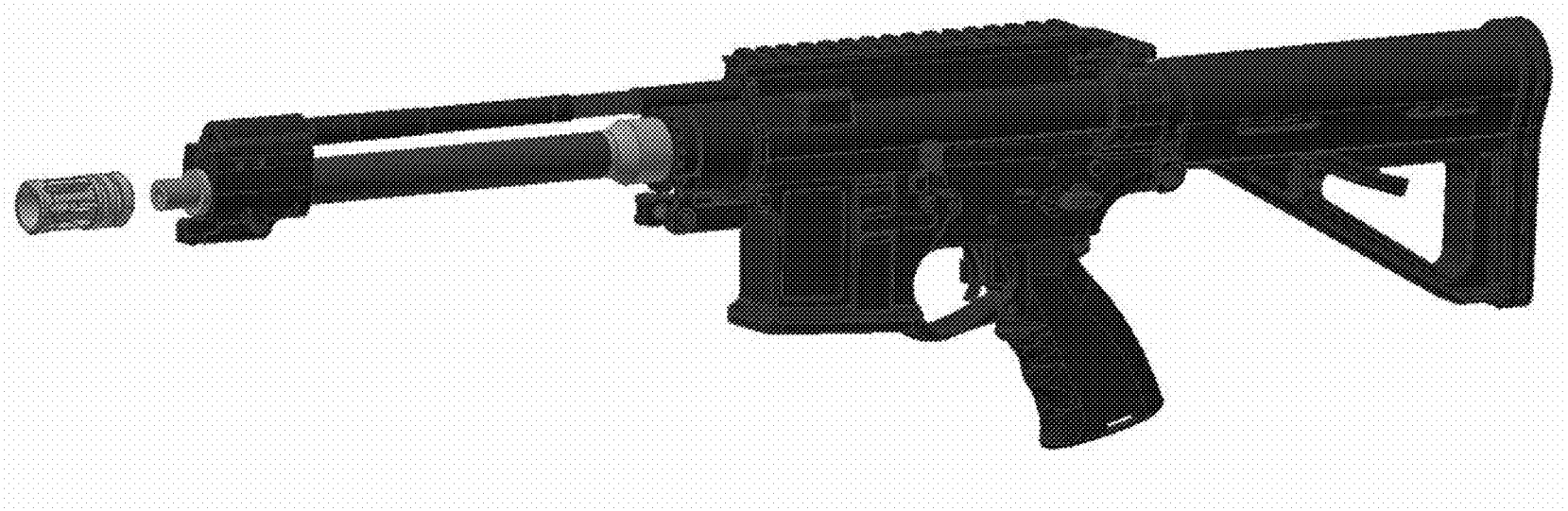
FIG. 22 is an exploded view of the modular barrel assembly configuration appearing in FIG. 21, with the handguard removed for ease of exposition.

FIGS. 19-22 shows the barrel system 200 attached to the upper receiver of a firearm 156. FIG. 19 illustrates an exemplary modular barrel assembly attached to a firearm in a long barrel configuration. FIG. 20 is an exploded view of the modular barrel assembly configuration appearing in FIG. 19, with the handguard 162 removed for ease of exposition. FIG. 21 illustrates the modular barrel system of FIG. 19 attached to a firearm in a short barrel configuration. FIG. 22 is an exploded view of the modular barrel assembly configuration appearing in FIG. 21, with the handguard 162 removed for ease of exposition. FIGS. 20 and 22 show configurations of the barrel system 200 attached to a firearm 156 with the handguard 162 to illustrate the attachment of a gas block 158 and gas tube 160 fluidically coupled to a gas port (not shown) in the barrel 200.

In this manner, the user can readily transition from a long barrel configuration to a short barrel configuration simply by unscrewing the secondary segment and moving the flash suppressor from the muzzle end of the secondary segment to the muzzle end of the primary segment, and vice versa. There is no need to remove the hand guard or gas tube, which can remain in position in both configurations. There is no need to remove the barrel nut on the receiver nor is there a need for any specialized tools typically required when removing and replacing a barrel, such as a vice, vice blocks, barrel nut wrench, torque wrench, and so forth.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A modular barrel system for firearm, comprising:

a first firearm barrel segment and a second firearm barrel segment, each of the first firearm barrel segment and the second firearm barrel segment configured to direct a path of a firearm projectile, each firearm barrel segment comprising a tubular member having an axial bore, a proximal end, and a distal end, wherein the axial bore of each of the first firearm barrel segment and the second firearm barrel segment is rifled;

the proximal end of the first firearm barrel segment having a first integral threaded element for removably attaching the first firearm barrel segment to a firearm;

the distal end of the first firearm barrel segment having a second integral threaded element;

the proximal end of the second firearm barrel segment having a third integral threaded element which is complementary with the second integral threaded element, the third integral threaded element for removably attaching the second firearm barrel segment to the first firearm barrel segment;

wherein the first firearm barrel segment has a first integral externally upset portion adjacent the second integral threaded element, wherein the tubular member of the first firearm barrel segment, the first integral threaded element, the second integral threaded element, and the first integral externally upset portion are parts of a first monolithic body and wherein the second firearm barrel segment has a second integral externally upset portion adjacent the third integral threaded element, wherein the tubular member of the second firearm barrel segment, the third integral threaded element, the fourth integral threaded element, and the second integral externally upset portion are parts of a second monolithic body, the first integral externally upset portion and the second integral externally upset portion abutting each other when the first firearm barrel segment is assembled to the second firearm barrel segment; and a locking mechanism, the locking mechanism comprising:

a first axially-extending groove formed in the first integral externally upset portion;

a second axially-extending groove formed in the second integral externally upset portion, the first and second axially-extending grooves being circumferentially aligned when the first and second firearm barrel segments are assembled together;

a locking bar slidably received within the second axially-extending groove;

a spring member having a first end fixed within the second axially-extending groove and a second end attached to the locking bar; and the spring member configured to urge a portion of the locking bar into the first axially-extending groove when the first and second firearm barrel segments are assembled together, the locking bar fitting together with the first and second axially-extending grooves so that the assembled first and second firearm barrel segments cannot substantially rotate with respect to each other.

2. The modular barrel system of claim 1, wherein the first firearm barrel segment is operable in a short barrel configuration when the second firearm barrel segment is removed from the first firearm barrel segment and wherein the first and second firearm barrel segments are operable in long barrel configuration when the first and second firearm barrel segments are assembled together.

3. The modular barrel system of claim 1, wherein the first and third integral threaded elements are male threaded elements having an external helical thread and the second integral threaded element is a female threaded element having an internal helical thread.

4. The modular barrel system of claim 1, wherein the distal end of the second firearm barrel segment has a fourth integral threaded element.

5. The modular barrel system of claim 4, wherein the fourth integral threaded element is a male threaded element configured to attach one or both of a firearm accessory device and a third firearm barrel segment to the second firearm barrel segment.

6. The modular barrel system of claim 4, further comprising:

a third firearm barrel segment comprising a tubular member having an axial bore, a proximal end, and a distal end; and the proximal end of the third firearm barrel segment having a fifth integral threaded element which is complementary with the fourth integral threaded element, the fifth integral threaded element for removably attaching the third firearm barrel segment to the second firearm barrel segment.

7. The modular barrel system of claim 1, further comprising:

a key member having a shaft portion slidably received in the first axially-extending groove for manually urging the locking bar out of the first axially-extending groove against the urging of the spring member to permit the first and second firearm barrel segments to rotate with respect to each other.

8. The modular barrel system of claim 1, wherein the first and second firearm barrel segments are formed from a single, monolithic piece of barrel stock material.

9. The modular barrel system of claim 1, wherein at least a portion of the first firearm barrel segment, second firearm barrel segment, or both, is wrapped with a fiber reinforced composite material.

10. The modular barrel system of claim 9, wherein the fiber reinforced composite material comprises carbon fibers in a polymer matrix.

11. The modular barrel system of claim 1, wherein rifling in the axial bore of each of the first and second firearm barrel segments comprises a plurality of helical grooves and wherein the plurality of helical grooves of the first firearm barrel segment are continuous and aligned with the plurality of helical grooves of the second firearm barrel segment at a joint between the first firearm barrel segment and the second firearm barrel segment when the first and second firearm barrel segments are assembled together.

12. A method of manufacturing a modular barrel system, the method comprising:

forming a first solid firearm barrel segment and a second solid firearm barrel segment, each of the first and second solid firearm barrel segments having a proximal end and a distal end, wherein said first solid firearm barrel segment has a first integral externally upset portion at the distal end thereof and the second solid firearm barrel segment has a second integral externally upset portion at the proximal end thereof;

forming a first integral threaded element on the proximal end of the first solid firearm barrel segment, the first integral threaded element for removably attaching the first solid firearm barrel segment to a firearm;

forming a second integral threaded element on the distal end of the first solid firearm barrel segment;

forming a third integral threaded element on the proximal end of the second solid firearm barrel segment, the third integral threaded element being complementary with the second integral threaded element, the third integral threaded element for removably attaching the second solid firearm barrel segment to the first solid firearm barrel segment;

assembling the first and second solid firearm barrel segments together;

forming an axial bore in the first and second solid firearm barrel segments to form first and second tubular barrel segments;

forming rifling on an inner surface of the axial bore of the first and second tubular barrel segments;

forming a first axially-extending groove in the first integral externally upset portion and a second axially-extending groove formed in the second integral externally upset portion, the first and second axially-extending grooves being circumferentially aligned; and providing a locking mechanism in the second axially extending groove, the locking mechanism comprising a locking bar slidably received within the second axially-extending groove and a spring member having a first end fixed within the second axially-extending groove and a second end attached to the locking bar, the spring member configured to urge a portion of the locking bar into the first axially-extending groove when the first and second tubular barrel segments are assembled together;

wherein the first tubular barrel segment, the first integral threaded element, the second integral threaded element, and the first integral externally upset portion are parts of a first monolithic body and the second tubular barrel segment, the third integral threaded element, the fourth integral threaded element, and the second integral externally upset portion are parts of a second monolithic body.

13. The method of claim 12, wherein the rifling formed on the inner surface of axial bore of the first tubular barrel segment comprises a first plurality of helical grooves and the rifling formed on the inner surface of axial bore of the second tubular barrel segment comprises a second plurality of helical grooves, and further wherein the first plurality of helical grooves are continuous and aligned with the second plurality of helical grooves when the first and second tubular barrel segments are assembled together.

14. The method of claim 12, wherein said steps of forming the first and third integral threaded elements comprise forming male threaded elements having an external helical thread and said steps of forming the second integral threaded element comprises forming a female threaded element having an internal helical thread.

15. The method of claim 12, further comprising:

prior to forming the first and second solid firearm barrel segments, machining a solid piece of stock material to form a monolithic outline of the modular barrel system; and cutting the monolithic outline into said first and second solid firearm barrel segments.

16. The method of claim 12, wherein:

the monolithic outline has an enlarged diameter portion; and said cutting the monolithic outline into the first and second solid firearm barrel segments is performed at the enlarged diameter portion to provide the first solid firearm barrel segment having a first integral externally upset portion at the distal end of the first solid firearm barrel segment and the second solid firearm barrel segment having a second integral externally upset portion at the proximal end of the second solid firearm barrel segment.

* * * * *